US005737940A

United States Patent [19]

Yao et al.

[11] Patent Number: 5,737,940

[45] Date of Patent: Apr. 14, 1998

[54] AROMATICS AND/OR HEAVIES REMOVAL FROM A METHANE-BASED FEED BY CONDENSATION AND STRIPPING

[76] Inventors: Jame Yao, 1151 Gloria Ct., Sugar Land, Tex. 77478; Clarence G. Houser, 3300 Sage Rd. Apt. 6305, Houston, Tex. 77056; William R. Low, 1000 Grandview Rd., Bartlesville, Okla. 74006

[21] Appl. No.: 659,732

[22] Filed: Jun. 7, 1996

[51] Int. Cl.[6] ..... F25J 3/02

[52] U.S. Cl. ..... 62/620; 62/625; 62/632

[58] Field of Search ..... 62/620, 625, 627, 62/630, 632

[56] References Cited

U.S. PATENT DOCUMENTS

| | | | |
|---|---|---|---|
| 3,021,682 | 2/1962 | Baker et al. | 62/632 |
| 3,408,824 | 11/1968 | Karbosky et al. . | |
| 3,436,925 | 4/1969 | Jakob | 62/632 |
| 3,707,066 | 12/1972 | Carne et al. . | |
| 4,057,972 | 11/1977 | Sarsten . | |
| 4,172,711 | 10/1979 | Bailey . | |
| 4,185,978 | 1/1980 | McGalliard et al. . | |
| 4,430,103 | 2/1984 | Gray et al. | 62/620 |
| 4,456,461 | 6/1984 | Perez | 62/630 X |
| 4,457,768 | 7/1984 | Bellinger . | |
| 4,695,303 | 9/1987 | Montgomery, IV et al. | 62/625 X |
| 4,711,651 | 12/1987 | Sharma et al. | 62/630 |
| 4,952,305 | 8/1990 | Kummann | 62/625 X |
| 5,026,408 | 6/1991 | Saunders et al. | 62/620 |
| 5,035,732 | 7/1991 | McCue, Jr. | 62/627 |

OTHER PUBLICATIONS

Liptak, B. G. "Instrument Engineers Handbook", vol. II, pp. 48–49.

Liptak, B. G. "Instrument Engineers Handbook", vol. II, pp. 940–942.

Kniel, L. (9173). *Chemical Engineering Progress* (vol. 69, No. 10) entitled "Energy Systems for LNG Plants".

Harper, E. A. Rust, J. R. and Lean, L. E(1975). *Chemical Engineering Progress* (vol. 71, No. 11) entitled "Trouble Free LNG".

Haggin, J. (1992). *Chemical and Engineering News* (Aug. 17, 1992) entitled "Large Scale Technology Characterizes Global LNG Activities" provides background information concerning the relative scale of projects for natural gas liquefaction.

Collins, C., Durr, C. A., de la Vega, F.F. and Hill, D. L. (1995). *Hydrocarbon Processing* (Apr. 1995) entitled "Liquefaction Plant Design in the 1990s" generally discloses basic background information concerning recent developments in the production of LNG.

*Primary Examiner*—Christopher Kilner
*Attorney, Agent, or Firm*—Gary L. Haag

[57] ABSTRACT

A process and associated apparatus for removing aromatics and/or higher molecular weight hydrocarbons from a methane-based gas stream comprising the steps of (a) condensing a minor portion of the methane-based gas stream thereby producing a two-phase stream, (b) feeding said two phase stream to the upper section of a column, (c) removing from the upper section of the column an aromatic- and/or heavies-depleted gas stream, (d) removing from the lower section of the column an aromatic- and/or heavies-rich liquid stream, (e) contacting via indirect heat exchange the aromatic- and/or heavies-rich liquid stream with a methane-rich stripping gas thereby producing a warmed liquid stream and a cooled stripping gas stream, (f) feeding said cooled stripping gas stream to the lower section of the column; and (g) contacting said two-phase stream and the cooled stripping gas stream in the column thereby producing the aromatic- and/or heavies-depleted gas stream and the aromatic- and/or heavies-rich liquid stream.

54 Claims, 2 Drawing Sheets

AROMATICS AND/OR HEAVIES REMOVAL FROM A METHANE-BASED FEED BY CONDENSATION AND STRIPPING

This invention concerns a method and associated apparatus for removing benzene, other aromatics and/or heavier hydrocarbon components from a methane-based gas stream by a unique condensation and stripping process.

BACKGROUND

Cryogenic liquefaction of normally gaseous materials is utilized for the purposes of component separation, purification, storage and for the transportation of said components in a more economic and convenient form. Most such liquefaction systems have many operations in common, regardless of the gases involved, and consequently, have many of the same problems. One problem commonly encountered in liquefaction processes, particularly when aromatics are present, is the precipitation and subsequent solidification of these species in the process equipment thereby resulting in reduced process efficiency and reliability. Another common problem is the removal of small quantities of the higher valued, higher molecular weight chemical species from the gas stream immediately prior to liquefaction of the gas stream in a major portion. Accordingly, the present invention will be described with specific reference to the processing of natural gas but is applicable to the processing of gas in other systems wherein similar problems are encountered.

It is common practice in the art of processing natural gas to subject the gas to cryogenic treatment to separate hydrocarbons having a molecular weight higher than methane ($C_2$+) from the natural gas thereby producing a pipeline gas predominating in methane and a $C_2$+ stream useful for other purposes. Frequently, the $C_2$+ stream will be separated into individual component streams, for example, $C_2$, $C_3$, $C_4$ and $C_5$+.

It is also common practice to cryogenically treat natural gas to liquefy the same for transport and storage. The primary reason for the liquefaction of natural gas is that liquefaction results in a volume reduction of about 1/600, thereby making it possible to store and transport the liquefied gas in containers of more economical and practical design. For example, when gas is transported by pipeline from the source of supply to a distant market, it is desirable to operate the pipeline under a substantially constant and high load factor. Often the deliverability or capacity of the pipeline will exceed demand while at other times the demand may exceed the deliverability of the pipeline. In order to shave off the peaks where demand exceeds supply, it is desirable to store the excess gas in such a manner that it can be delivered when the supply exceeds demand, thereby enabling future peaks in demand to be met with material from storage. One practical means for doing this is to convert the gas to a liquefied state for storage and to then vaporize the liquid as demand requires.

Liquefaction of natural gas is of even greater importance in making possible the transport of gas from a supply source to market when the source and market are separated by great distances and a pipeline is not available or is not practical. This is particularly true where transport must be made by ocean-going vessels. Ship transportation in the gaseous state is generally not practical because appreciable pressurization is required to significantly reduce the specific volume of the gas which in turn requires the use of more expensive storage containers.

In order to store and transport natural gas in the liquid state, the natural gas is preferably cooled to −240° F. to −260° F. where it possesses a near-atmospheric vapor pressure. Numerous systems exist in the prior art for the liquefaction of natural gas or the like in which the gas is liquefied by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, and methane or a combination of one or more of the preceding. In the art, the refrigerants are frequently arranged in a cascaded manner and each refrigerant is employed in a closed refrigeration cycle. Further cooling of the liquid is possible by expanding the liquefied natural gas to atmospheric pressure in one or more expansion stages. In each stage, the liquefied gas is flashed to a lower pressure thereby producing a two-phase gas-liquid mixture at a significantly lower temperature. The liquid is recovered and may again be flashed. In this manner, the liquefied gas is further cooled to a storage or transport temperature suitable for liquefied gas storage at near-atmospheric pressure. In this expansion to near-atmospheric pressure, some additional volumes of liquefied gas are flashed. The flashed vapors from the expansion stages are generally collected and recycled for liquefaction or utilized as fuel gas for power generation.

As previously noted, a major operational problem in the liquefaction of natural gas is the removal of residual amounts of benzene and other aromatic compounds from the natural gas stream immediately prior to the liquefaction of a major portion of said stream and the tendency of such components to precipitate and solidify thereby causing the fouling and potential plugging of pipes and key process equipment. As an example, such fouling can significantly reduce the heat transfer efficiency and throughput of heat exchangers, particularly plate-fin heat exchangers.

A second problem in the processing of methane-rich gas streams is the lack of a cost-effective means for recovering the higher molecular weight hydrocarbons from the gas stream prior to liquefaction of the stream in major portion or returning the remaining stream to a pipeline or other processing step. The recovered higher molecular weight hydrocarbons generally possess a greater value on a per unit mass basis than the remaining components in the gas stream.

SUMMARY OF THE INVENTION

It is an object of this invention to remove residual quantities of benzene and other aromatics from a methane-based gas stream which is to be liquefied in major portion.

It is another object of this invention to remove the higher molecular weight hydrocarbons from a methane-based gas stream.

It is still yet another object of this invention to remove the higher molecular weight hydrocarbons from a methane-based gas stream which is to be liquefied in a major portion.

It is yet still further an object of this invention to remove benzene, other aromatics and/or the higher molecular weight hydrocarbons from methane-based gas stream in an energy-efficient manner.

It is still further an object of the present invention that the process employed for the removal of benzene, other aromatics and/or higher molecular weight hydrocarbons be compatible with and integrate into technology routinely employed in gas plants.

And further yet still, it is an object of this invention that the process and apparatus employed for benzene, other aromatic and/or high molecular weight hydrocarbon removal from a methane-based gas stream be relatively simple, compact and cost-effective.

It still further yet is an object of the present invention that the process employed for the removal of benzene, other aromatics and/or higher molecular hydrocarbons from a methane-based gas stream to be liquefied in major portion be compatible with and integrate into technology routinely employed in plants producing liquefied natural gas.

In one embodiment of this invention, benzene and/or other aromatics are removed from a methane-based gas stream by a process comprising (1) condensing a minor portion of the methane-based gas stream immediately prior to the step wherein a majority of said gas stream is liquefied thereby producing a two-phase stream, (2) feeding said two-phase stream into the upper section of a stripping column, (3) removing from the upper section of said stripping column an aromatic-depleted gas stream, (4) removing from the lower section of said stripping column an aromatic-rich liquid stream, (5) contacting via indirect heat exchange the aromatic-rich liquid stream with a methane-rich stripping gas stream thereby producing a warmed aromatic-bearing stream and a cooled methane-rich stripping gas stream, and (6) feeding said cooled methane-rich stripping gas stream to the lower section of the stripping column, and optionally (7) feeding said aromatic-depleted gas stream to a liquefaction step wherein the gas stream is liquefied in major portion thereby producing liquefied natural gas.

In another embodiment of this invention, the higher molecular weight hydrocarbons in a methane-based gas stream are removed and concentrated by a process comprising (1) condensing a minor portion of the methane-based gas stream to produce a two-phase stream, (2) feeding said two-phase stream into the upper section of a stripping column, (3) removing from the upper section of said stripping column a heavies-depleted gas stream, (4) removing the lower section of said stripping column a heavies-rich liquid stream, (5) contacting via indirect heat exchange the heavies-rich liquid stream with a methane-rich stripping gas stream thereby producing a warmed heavies-rich stream and a cooled methane-rich stripping gas stream, and (6) feeding said methane-rich stripping gas stream to the lower section of the stripping column.

In still yet another embodiment of this invention, the invention is an apparatus comprising (1) a condenser wherein a minor portion of a methane-based gas stream is condensed thereby producing a two-phase stream, (2) a stripping column to which the two-phase stream is fed and from which is produced a vapor stream and a liquid stream, (3) a heat exchanger containing an indirect heat exchange means which provides for indirect heat exchange between a gas stream and the liquid stream thereby producing a cooled gas stream and a warmed liquid stream, (4) a conduit between said condenser and the upper section of the stripping column for flow of said two-phase stream, (5) a conduit connected to the upper section of the stripping column for removal of said vapor stream, (6) a conduit between said stripping column and said heat exchanger for flow of said liquid stream, (7) a conduit between said heat exchanger and said stripping column for flow of said cooled gas stream, (8) a conduit connected to said heat exchanger for the flow of a said warmed liquid stream from the heat exchanger, and (9) a conduit connected to said heat exchanger for flow of said gas stream to the heat exchanger.

DESCRIPTION OF THE PREFERRED EMBODIMENTS

Figure 1:
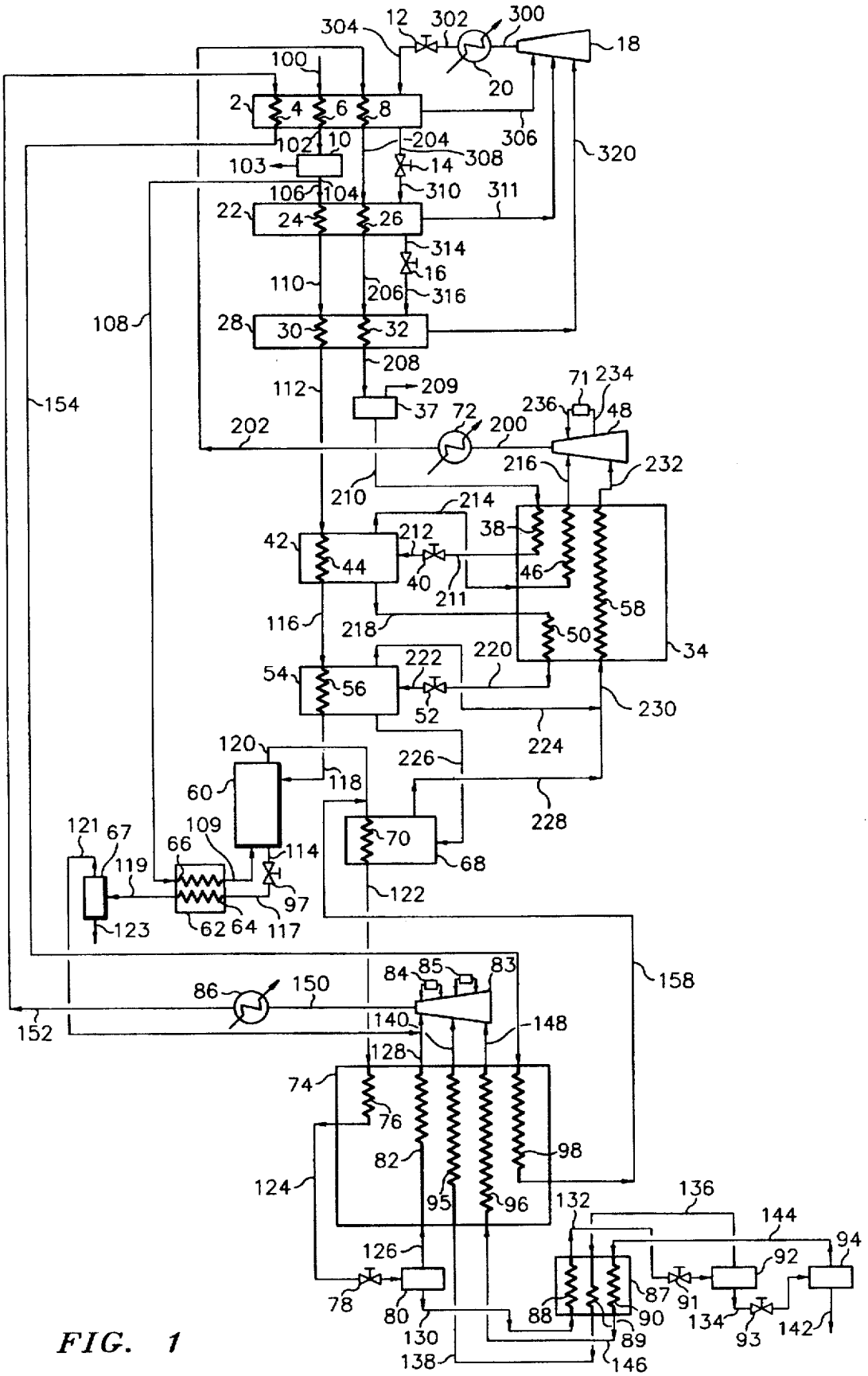
FIG. 1 is a simplified flow diagram of a cryogenic LNG production process which illustrates the methodology and apparatus of the present invention for the removal of benzene, other aromatics and/or higher molecular weight hydrocarbon species from a methane-based gas stream.

While the present invention in the preferred embodiments is applicable to (1) the removal of benzene and/or other aromatics from a methane-based gas stream which is to be condensed in major portion and (2) the removal of the more valuable, higher molecular weight hydrocarbon species from a methane-based gas stream which is to be condensed in major portion, the technology is also applicable to the generic recovery of such species from methane-based streams (e.g., removal of natural gas liquids from natural gas). Benzene and other aromatics present a unique problem because of their relatively high melting point temperatures. As an example, benzene which contains 6 carbon atoms possesses a melting point of 5.5° C. and a boiling point of 80.1° C. Hexane, which also contains 6 carbon atoms, possesses a melting point of −95° C. and a boiling point of 68.95° C. Therefore when compared to other hydrocarbons of similar molecular weight, benzene and other aromatic compounds pose a much greater problem with regard to fouling and/or plugging of process equipment and conduit. Aromatic compounds as used herein are those compounds characterized by the presence of at least one benzene ring. As used herein, higher molecular hydrocarbon species are those hydrocarbon species possessing, molecular weight greater than ethane, and this term will be used interchangeably with heavy hydrocarbons.

For the purposes of simplicity and clarity, the following description will be confined to the employment of the inventive processes and associated apparatus in the cryogenic cooling of a natural gas stream to produce liquefied natural gas. More specifically, the following description will focus on the removal of benzene and/or other aromatic species and/or higher molecular weight hydrocarbons (heavy hydrocarbons) in a liquefaction scheme wherein cascaded refrigeration cycles are employed. However, the applicability of the inventive processes and associated apparatus herein described is not limited to liquefaction systems which employ cascaded refrigeration cycles or which process natural gas streams exclusively. The processes and associated apparatus are applicable to any refrigeration system wherein (a) benzene and/or heavier aromatics exist in a methane-based gas stream at concentrations which may foul or plug process equipment, particularly the heat exchangers employed for condensing said stream, or (b) it is desirable for whatever reason to remove and recover higher molecular weight hydrocarbons from a methane-based gas stream.

Natural Gas Stream Liquefaction

Cryogenic plants have a variety of forms; the most efficient and effective being a cascade-type operation and this type in combination with expansion-type cooling. Also, since methods for the production of liquefied natural gas (LNG) include the separation of hydrocarbons of molecular weight greater than methane as a first part thereof, a description of a plant for the cryogenic production of LNG effectively describes a similar plant for removing $C_2$+ hydrocarbons from a natural gas stream.

In the preferred embodiment which employs a cascaded refrigerant system, the invention concerns the sequential cooling of a natural gas stream at an elevated pressure, for example about 650 psia, by sequentially cooling the gas stream by passage through a multistage propane cycle, a multistage ethane or ethylene cycle and either (a) a closed methane cycle followed by a single- or a multistage expansion cycle to further cool the same and reduce the pressure to near-atmospheric or (b) an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point.

Pretreatment steps provide a means for removing undesirable components such as acid gases, mercaptans, mercury and moisture from the natural gas feed stream delivered to the facility. The composition of this gas stream may vary significantly. As used herein, a natural gas stream is any stream principally comprised of methane which originates in major portion from a natural gas feed stream, such feed stream for example containing at least 85% methane by volume, with the balance being ethane, higher hydrocarbons, nitrogen, carbon dioxide and a minor amounts of other contaminants such as mercury, hydrogen sulfide, mercaptans. The pretreatment steps may be separate steps located either upstream of the cooling cycles or located downstream of one of the early stages of cooling in the initial cycle. The following is a non-inclusive listing of some of the available means which are readily available to one skilled in the art. Acid gases and to a lesser extent mercaptans are routinely removed via a sorption process employing an aqueous amine-bearing solution. This treatment step is generally performed upstream of the cooling stages employed in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves. Processes employing sorbent beds are generally located downstream of the first cooling stage in the initial cooling cycle.

The resulting natural gas stream is generally delivered to the liquefaction process at an elevated pressure or is compressed to an elevated pressure, that being a pressure greater than 500 psia, preferably about 500 to about 900 psia, still more preferably about 550 to about 675 psia, still yet more preferably about 575 to about 650 psia, and most preferably about 600 psia. The stream temperature is typically near ambient to slightly above ambient. A representative temperature range being 60° F. to 120° F.

As previously noted, the natural gas stream at this point is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such refrigerant is preferably comprised in major portion of propane, propylene or mixtures thereof, more preferably propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such refrigerant is preferably comprised in major portion of ethane, ethylene or mixtures thereof, more preferably ethylene, and most preferably the refrigerant consists essentially of ethylene. Each of the above-cited cooling stages for each refrigerant comprises a separate cooling zone.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$ and higher molecular weight hydrocarbons from the gas to produce a first gas stream predominating in methane and a second liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separators will be dependant on a number of operating parameters, such as the $C_2$+ composition of the natural gas feed stream, the desired BTU content of the final product, the value of the $C_2$+ components for other applications and other factors routinely considered by those skilled in the art of LNG plant and gas plant operation. The $C_2$+ hydrocarbon stream or streams may be demethanized via a single stage flash or a fractionation column. In the former case, the methane-rich stream can be repressurized and recycled or can be used as fuel gas. In the latter case, the methane-rich stream can be directly returned at pressure to the liquefaction process. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (ex., $C_2$, $C_3$, $C_4$ and $C_5$+). In the last stage of the second cooling cycle, the gas stream which is predominantly methane is condensed (i.e., liquefied) in major portion, preferably in its entirety. In one of the preferred embodiments to be discussed in greater detail in a later section, it is at this location in the process that the inventive process and associated apparatus for benzene, other aromatics and/or heavier hydrocarbon removal can be employed. The process pressure at this location is only slightly lower than the pressure of the feed gas to the first stage of the first cycle.

The liquefied natural gas stream is then further cooled in a third step or cycle by one of two embodiments. In one embodiment, the liquefied natural gas stream is further cooled by indirect heat exchange with a third closed refrigeration cycle wherein the condensed gas stream is subcooled via passage through an effective number of stages, nominally 2; preferably two to 4; and most preferably 3 wherein cooling is provided via a third refrigerant having a boiling point lower than the refrigerant employed in the second cycle. This refrigerant is preferably comprised in major portion of methane and more preferably is predominantly methane. In the second and preferred embodiment which employs an open methane refrigeration cycle, the liquefied natural gas stream is subcooled via contact with flash gases in a main methane economizer in a manner to be described later.

In the fourth cycle or step, the liquefied gas is further cooled by expansion and separation of the flash gas from the cooled liquid. In a manner to be described, nitrogen removal from the system and the condensed product is accomplished either as part of this step or in a separate succeeding step. A key factor distinguishing the closed cycle from the open cycle is the initial temperature of the liquefied stream prior to flashing to near-atmospheric pressure, the relative amounts of flashed vapor generated upon said flashing, and the disposition of the flashed vapors. Whereas the majority of the flash vapor is recycled to the methane compressors in the open-cycle system, the flashed vapor in a closed-cycle system is generally utilized as a fuel.

In the fourth cycle or step in either the open- or closed-cycle methane systems, the liquefied product is cooled via at least one, preferably two to four, and more preferably three expansions where each expansion employs either Joule-Thomson expansion valves or hydraulic expanders followed by a separation of the gas-liquid product with a separator. When a hydraulic expander is employed and properly operated, the greater efficiencies associated with the recovery of power, a greater reduction in stream temperature, and the production of less vapor during the flash step will frequently be cost-effective even in light of increased capital and operating costs associated with the expander. In one embodiment employed in the open-cycle system, additional cooling of the high pressure liquefied product prior to flashing is made possible by first flashing a portion of this stream via one or more hydraulic expanders and then via indirect heat exchange means employing said flashed stream to cool the high pressure liquefied stream prior to flashing. The flashed product is then recycled via return to an appropriate location, based on temperature and pressure considerations, in the open methane cycle.

When the liquid product entering the fourth cycle is at the preferred pressure of about 600 psia, representative flash pressures for a three stage flash process are about 190, 61 and 14.7 psia. In the open-cycle system, vapor flashed or fractionated in the nitrogen separation step to be described and that flashed in the expansion flash steps are utilized as cooling agents in the third step or cycle which was previously mentioned. In the closed-cycle system, the vapor from the flash stages may also be employed as a cooling agent prior to either recycle or use as fuel. In either the open- or closed-cycle system, flashing of the liquefied stream to near atmospheric pressure will produce an LNG product possessing a temperature of −240° F. to −260° F.

To maintain the BTU content of the liquefied product at an acceptable limit when appreciable nitrogen exists in the feed stream, nitrogen must be concentrated and removed at some location in the process. Various techniques for this purpose are available to those skilled in the art. The following are examples. When an open methane cycle is employed and nitrogen concentration in the feed is low, typically less than about 1.0 vol %, nitrogen removal is generally achieved by removing a small side stream at the high pressure inlet or outlet port at the methane compressor. For a closed cycle at nitrogen concentrations of up to 1.5 vol.% in the feed gas, the liquefied stream is generally flashed from process conditions to near-atmospheric pressure in a single step, usually via a flash drum. The nitrogen-bearing flash vapors are then generally employed as fuel gas for the gas turbines which drive the compressors. The LNG product which is now at near-atmospheric pressure is routed to storage. When the nitrogen concentration in the inlet feed gas is about 1.0 to about 1.5 vol % and an open-cycle is employed, nitrogen can be removed by subjecting the liquefied gas stream from the third cooling cycle to a flash step prior to the fourth cooling step. The flashed vapor will contain an appreciable concentration of nitrogen and may be subsequently employed as a fuel gas. A typical flash pressure for nitrogen removal at these concentrations is about 400 psia. When the feed stream contains a nitrogen concentration of greater than about 1.5 vol % and an open or closed cycle is employed, the flash step may not provide sufficient nitrogen removal. In such event, a nitrogen rejection column will be employed from which is produced a nitrogen rich vapor stream and a liquid stream. In a preferred embodiment which employs a nitrogen rejection column, the high pressure liquefied methane stream to the methane economizer is split into a first and second portion. The first portion is flashed to approximately 400 psia and the two-phase mixture is fed as a feed stream to the nitrogen rejection column. The second portion of the high pressure liquefied methane stream is further cooled by flowing through a methane economizer to be described later, it is then flashed to 400 psia, and the resulting two-phase mixture or the liquid portion thereof is fed to the upper section of the column where it functions as a reflux stream reflux. The nitrogen-rich vapor stream produced from the top of the nitrogen rejection column will generally be used as fuel. The liquid stream produced from the bottom of the column is then fed to the first stage of methane expansion.

Refrigerative Cooling for Natural Gas Liquefaction

Critical to the liquefaction of natural gas in a cascaded process is the use of one or more refrigerants for transferring heat energy from the natural gas stream to the refrigerant and ultimately transferring said heat energy to the environment. In essence, the refrigeration system functions as a heat pump by removing heat energy from the natural gas stream as the stream is progressively cooled to lower and lower temperatures.

The liquefaction process employs several types of cooling which include but are not limited to (a) indirect heat exchange, (b) vaporization and (c) expansion or pressure reduction. Indirect heat exchange, as used herein, refers to a process wherein the refrigerant or cooling agent cools the substance to be cooled without actual physical contact between the refrigerating agent and the substance to be cooled. Specific examples include heat exchange undergone in a tube-and-shell heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, in the inventive process, a shell-and-tube heat exchange will typically be utilized where the refrigerating agent is in a liquid state and the substance to be cooled is in a liquid or gaseous state, whereas, a plate-fin heat exchanger will typically be utilized where the refrigerant is in a gaseous state and the substance to be cooled is in a liquid state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas-, liquid- or a two-phase system is decreased by passing through a pressure reduction means. In one embodiment, this expansion means is a Joule-Thomson expansion valve. In another embodiment, the expansion means is a hydraulic or gas expander. Because expanders recover work energy from the expansion process, lower process stream temperatures are possible upon expansion.

In the discussion and drawings to follow, the discussions or drawings may depict the expansion of a refrigerant by flowing through a throttle valve followed by a subsequent separation of gas and liquid portions in the refrigerant chillers or condensers, as the case may be, wherein indirect heat-exchange also occurs. While this simplified scheme is workable and sometimes preferred because of cost and simplicity, it may be more effective to carry out expansion and separation and then partial evaporation as separate steps, for example a combination of throttle valves and flash drums prior to indirect heat exchange in the chillers or condensers. In another workable embodiment, the throttle or expansion valve may not be a separate item but an integral part of the refrigerant chiller or condenser (i.e., the flash occurs upon entry of the liquefied refrigerant into the chiller). In a like manner, the cooling of multiple streams for a given refrigeration stage may occur within a single vessel (i.e., chiller) or within multiple vessels. The former is generally preferred from a capital equipment cost perspective.

In the first cooling cycle, cooling is provided by the compression of a higher boiling point gaseous refrigerant, preferably propane, to a pressure where it can be liquefied by indirect heat transfer with a heat transfer medium which ultimately employs the environment as a heat sink, that heat sink generally being the atmosphere, a fresh water source, a salt water source, the earth or two or more of the preceding. The condensed refrigerant then undergoes one or more steps of expansion cooling via suitable expansion means thereby producing two-phase mixtures possessing significantly lower temperatures. In one embodiment, the main stream is split into at least two separate streams, preferably two to four streams, and most preferably three streams where each stream is separately expanded to a designated pressure. Each stream then provides evaporative cooling via indirect heat transfer with one or more selected streams, one such stream being the natural gas stream to be liquefied. The number of separate refrigerant streams will correspond to the number of refrigerant compressor stages. The vaporized refrigerant from each respective stream is then returned to the appropriate stage at the refrigerant compressor (e.g., two separate streams will correspond to a two-stage compressor). In a more preferred embodiment, all liquefied refrigerant is expanded to a predesignated pressure and this stream then employed to provide vaporative cooling via indirect heat transfer with one or more selected streams, one such stream being the natural gas stream to be liquefied. A portion of the liquefied refrigerant is then removed from the indirect heat transfer means, expansion cooled by expanding to a lower pressure and correspondingly lower temperature where it provides vaporative cooling via indirect heat transfer means with one or more designated streams, one such stream being the natural gas stream to be liquefied. Nominally, this embodiment will employ two such expansion cooling/vaporative cooling steps, preferably two to four, and most preferably three. Like the first embodiment, the refrigerant vapor from each step is returned to the appropriate inlet port at the staged compressor.

In the preferred cascaded embodiment, the majority of the cooling for liquefaction of the lower boiling point refrigerants (i.e., the refrigerants employed in the second and third cycles) is made possible by cooling these streams via indirect heat exchange with selected higher boiling refrigerant streams. This manner of cooling is referred to as "cascaded cooling." In effect, the higher boiling refrigerants function as heat sinks for the lower boiling refrigerants or stated differently, heat energy is pumped from the natural gas stream to be liquefied to a lower boiling refrigerant and is then pumped (i.e., transferred) to one or more higher boiling refrigerants prior to transfer to the environment via an environmental heat sink (ex., fresh water, salt water, atmosphere). As in the first cycle, refrigerant employed in the second and third cycles are compressed via multi-staged compressors to preselected pressures. When possible and economically feasible, the compressed refrigerant vapor is first cooled via indirect heat exchange with one or more cooling agents (ex., air, salt water, fresh water) directly coupled to environmental heat sinks. This cooling may be via inter-stage cooling between compression stages and/or cooling of the compressed product. The compressed stream is then further cooled via indirect heat exchange with one or more of the previously discussed cooling stages for the higher boiling point refrigerants.

The second cycle refrigerant, preferably ethylene, is preferably first cooled via indirect heat exchange with one or more cooling agents directly coupled to an environmental heat sink (i.e., inter-stage and/or post-cooling following compression) and then further cooled and finally liquefied via sequential contact with the first and second or first, second and third cooling stages for the highest boiling point refrigerant which is employed in the first cycle. The preferred second and first cycle refrigerants are ethylene and propane, respectively.

When employing a three refrigerant cascaded closed cycle system, the refrigerant in the third cycle is compressed in a stagewise manner, preferably though optionally cooled via indirect heat transfer to an environmental heat sink (i.e., inter-stage and/or post-cooling following compression) and then cooled by indirect heat exchange with either all or selected cooling stages in the first and second cooling cycles which preferably employ propane and ethylene as respective refrigerants. Preferably, this stream is contacted in a sequential manner with each progressively colder stage of refrigeration in the first and second cooling cycles, respectively.

In an open-cycle cascaded refrigeration system such as that illustrated in FIG. 1, the first and second cycles are operated in a manner analogous to that set forth for the closed cycle. However, the open methane cycle system is readily distinguished from the conventional closed refrigeration cycles. As previously noted in the discussion of the fourth cycle or step, a significant portion of the liquefied natural gas stream originally present at elevated pressure is cooled to approximately −260° F. by expansion cooling in a stepwise manner to near-atmospheric pressure. In each step, significant quantities of methane-rich vapor at a given pressure are produced. Each vapor stream preferably undergoes significant heat transfer in methane economizers and is preferably returned to the inlet port of a compressor stage at near-ambient temperature. In the course of flowing through the methane economizers, the flashed vapors are contacted with warmer streams in a countercurrent manner and in a sequence designed to maximize the cooling of the warmer streams. The pressure selected for each stage of expansion cooling is such that for each stage, the volume of gas generated plus the compressed volume of vapor from the adjacent lower stage results in efficient overall operation of the multi-staged compressor. Interstage cooling and cooling of the final compressed gas is preferred and preferably accomplished via indirect heat exchange with one or more cooling agents directly coupled to an environmental heat sink. The compressed methane-rich stream is then further cooled via indirect heat exchange with refrigerant in the first and second cycles, preferably all stages associated with the refrigerant employed in the first cycle, more preferably the first two stages and most preferably, only the first stage. The cooled methane-rich stream is further cooled via indirect heat exchange with flash vapors in the main methane economizer and is then combined with the natural gas feed stream at a location in the liquefaction process where the natural gas feed stream and the cooled methane-rich stream are at similar conditions of temperature and pressure, preferably prior to entry into one of the stages of ethylene cooling, more preferably immediately prior to the ethylene cooling stage wherein methane in major portion is liquefied (i.e., ethylene condenser).

Optimization via Inter-stage and Inter-cycle Heat Transfer

In the more preferred embodiments, steps are taken to further optimize process efficiency by returning the refrigerant gas streams to the inlet port of their respective compressors at or near ambient temperature. Not only does this step improve overall efficiencies, but difficulties associated with the exposure of compressor components to cryogenic conditions are greatly reduced. This is accomplished via the use of economizers wherein streams comprised in major portion of liquid and prior to flashing are first cooled by indirect heat exchange with one or more vapor streams generated in a downstream expansion step (i.e., stage) or steps in the same or a downstream cycle. In a closed system, economizers are preferably employed to obtain additional cooling from the flashed vapors in the second and third cycles. When an open methane cycle system is employed, flashed vapors from the fourth stage are preferably returned to one or more economizers where (1) these vapors cool via indirect heat exchange the liquefied product streams prior to each pressure reduction stage and (2) these vapors cool via indirect heat exchange the compressed vapors from the open methane cycle prior to combination of this stream or streams with the main natural gas feed stream. These cooling steps comprise the previously discussed third stage of cooling and will be discussed in greater detail in the discussion of FIG. 1. In one embodiment wherein ethylene and methane are employed in the second and third cycles, the contacting can be performed via a series of ethylene and methane economizers. In a preferred embodiment which is illustrated in FIG. 1 and which will be discussed in greater detail later, the process employs a main ethylene economizer, a main methane economizer and one or more additional methane economizers. These additional economizers are referred to herein as the second methane economizer, the third methane economizer and so forth and each such additional methane economizer corresponds to a separate downstream flash step.

Benzene, Other Aromatic and/or Heavier Hydrocarbon Removal

The inventive process for the removal of benzene, other aromatics and/or the higher molecular weight hydrocarbon species from a methane-based gas stream is an extremely energy efficient and operationally simple process. Because of the manner of operation, the column referred to herein as a stripping column performs both stripping and fractionating functions. The process comprises cooling the methane-based gas stream such that 0.1 to 20 mol %, preferably 0.5 to about 10 mol %, and more preferably about 1.75 to about 6.0 mol % of the total gas stream is condensed thereby forming a two-phase stream. The optimal mole percentage will be dependant upon the composition of the gas undergoing liquefaction and other process-related parameters readily ascertained by one possessing ordinary skilled in the art.

In one embodiment, the desired two-phase stream is obtained by cooling the entire feed stream to such extent that the desired liquids percentage is obtained. In the preferred embodiment, the gas stream is first cooled to near the liequefaction temperature and is then split into a first stream and a second stream. The first stream undergoes additional cooling and partial condensation and is then combined with the second stream thereby producing a two-phase stream containing the desired percentage of liquids. This latter approach is preferred because of the associated ease of operation and process control.

The two-phase stream is then fed to the upper section of a column wherein the stream contacts the rising vapor stream from the lower portion of the column thereby producing a heavies-rich liquid stream which functions as a reflux stream and a heavies-depleted vapor stream which is produced from the column. As used herein, "heavies" will refer to any predominantly organic compound possessing a molecular weight greater than ethane. The column is unique in that it does not, as previously noted, employ a condenser for reflux generation and further, does not employ a reboiler for vapor generation.

As previously noted, a methane-rich stripping gas stream is fed to the column. This stream preferably originates from an upstream location where the methane-based gas stream undergoing cooling has undergone some degree of cooling and liquids removal. Prior to introduction into the base of the column, this gas stream is cooled via indirect contact, preferably in a countercurrent manner, with the liquid product produced from the bottom of the column thereby producing a warmed heavies-rich stream and a cooled methane-rich stripping gas stream. The methane-rich stripping gas may undergo partial condensation upon cooling and the resulting cooled methane-rich stripping gas containing two phases may be fed directly to the column.

The employment of the cooled methane-rich stripping gas which contains small amounts of $C_3$+ components in lieu of vapor generated from a reboiler which contains substantial amounts of $C_3$+ components significantly reduces problems associated with fluids in the column approaching critical conditions whereupon poor component separation results. This factor becomes particularly significant when operating in the more preferred pressure range of about 550 to about 675 psia. The critical temperature and pressure of methane is −116.4° F. and 673.3 psia. The critical temperature and pressure of propane is 206.2° F. and 617.4 psia and the critical temperature and pressure of n-butane is 305.7° F. and 551.25. The presence of appreciable quantities of $C_3$+ components will (1) lower the critical pressure thereby approaching the preferred operating pressures of the process and (2) raise the critical temperature. The resulting effect is to make the separation of the components via vapor/liquid contacting more difficult. A second factor distinguishing the uses of the cooled methane-rich stripping gas over vapor from a reboiler is the temperature difference between these respective streams and the liquid effluent from the last stage. Because it is preferred that the cooled methane-rich stripping gas be warmer than the analogous vapor from a reboiler, this preferred stream possesses a greater ability to strip the liquid phase of the lighter components. A temperature difference between the effluent liquid from the column and the effluent stripping gas to the column is more preferably 20° F. to 110°F., still more preferably 40° F. to 90°F., most preferably about 60° F. to about 80° F.

The number of theoretical trays in the column will be dependant upon the composition, temperature and flowrate of the inlet vapor stream to the column and the composition, temperature, flowrate and liquid to vapor ratio of the two-phase stream fed to the upper section of the column. Such determination is readily within the abilities of one possessing ordinary skill in the art. The theoretical number of trays may be provided via various types of column packing (pall rings, saddles etc) or distinct contact stages (ex. trays) situated in the column or a combination thereof. Generally, two (2) to fifteen (15) theoretical stages are required, more preferably three (3) to ten (10), still more preferably four (4) to eight (8), and most preferably about five (5) theoretical stages. Trays are generally preferred when the column diameter is greater than six (6) ft.

Preferred Open-Cycle Embodiment of Cascaded Liquefaction Process

Figure 2:
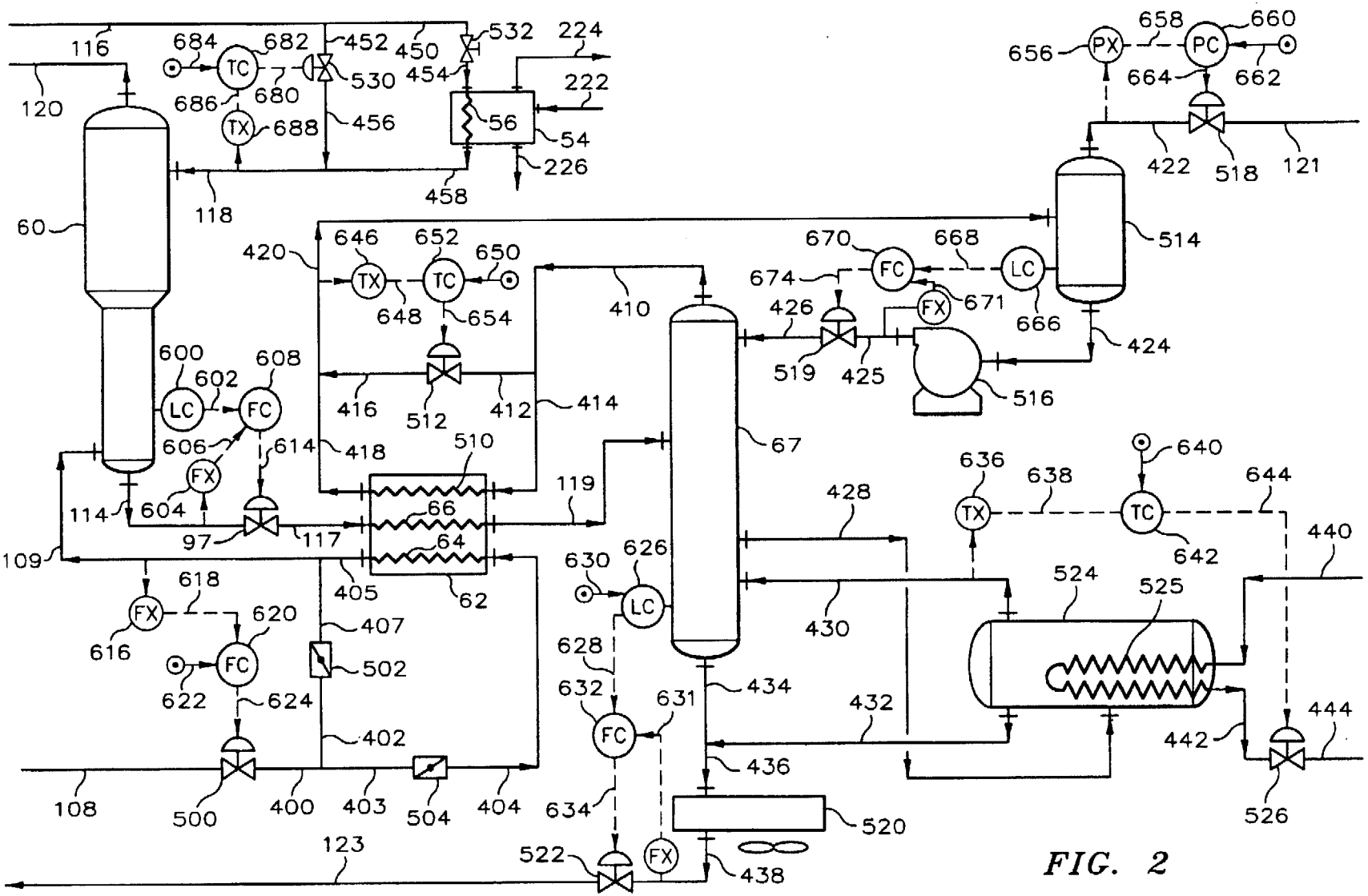
FIG. 2 is a simplified flow diagram which illustrates in greater detail the methodology and apparatus illustrated in FIG. 1.

The flow schematic and apparatus set forth in FIGS. 1 and 2 is a preferred embodiment of the open-cycle cascaded liquefaction process and is set forth for illustrative purposes. Purposely missing from the preferred embodiment is a nitrogen removal system, because such system is dependant on the nitrogen content of the feed gas. However as noted in the previous discussion of nitrogen removal technologies, methodologies applicable to this preferred embodiment are readily available to those skilled in the art. Those skilled in the art will also recognized that FIGS. 1 and 2 are schematics only and therefore, many items of equipment that would be needed in a commercial plant for successful operation have been omitted for the sake of clarity. Such items might include, for example, compressor controls, flow and level measurements and corresponding controllers, additional temperature and pressure controls, pumps, motors, filters, additional heat exchangers, valves, etc. These items would be provided in accordance with standard engineering practice.

To facilitate an understanding of FIGS. 1 and 2, items numbered 1 thru 99 are process vessels and equipment directly associated with the liquefaction process. Items numbered 100 thru 199 correspond to flow lines or conduits which contain methane in major portion. Items numbered 200 thru 299 correspond to flow lines or conduits which contain the refrigerant ethylene or optionally, ethane. Items numbered 300 thru 399 correspond to flow lines or conduits which contain the refrigerant propane. To the extent possible, the numbering system employed in FIG. 1 has been employed in FIG. 2. In addition, the following numbering system has been added for additional elements not illustrated in FIG. 1. Items numbered 400 thru 499 correspond to additional flow lines or conduits. Items numbered 500 thru 599 correspond to additional process equipment such as vessels, columns, heat exchange means and valves, including process control valves. Items numbered 600 thru 699 generally concern the process control system, exclusive of control valves, and specifically includes sensors, transducers, controllers and setpoint inputs.

Gaseous propane is compressed in multistage compressor 18 driven by a gas turbine driver which is not illustrated. The three stages of compression preferably exist in a single unit although each stage of compression may be a separate unit and the units mechanically coupled to be driven by a single driver. Upon compression, the compressed propane is passed through conduit 300 to cooler 20 where it is liquefied. A representative pressure and temperature of the liquefied propane refrigerant prior to flashing is about 100° F. and about 190 psia. Although not illustrated in FIG. 1, it is preferable that a separation vessel be located downstream of cooler 20 and upstream of a pressure reduction means, illustrated as expansion valve 12, for the removal of residual light components from the liquefied propane. Such vessels may be comprised of a single-stage gas-liquid separator or may be more sophisticated and comprised of an accumulator section, a condenser section and an absorber section, the latter two of which may be continuously operated or periodically brought on-line for removing residual light components from the propane. The stream from this vessel or the stream from cooler 20, as the case may be, is pass through conduit 302 to a pressure reduction means, illustrated as expansion valve 12, wherein the pressure of the liquefied propane is reduced thereby evaporating or flashing a portion thereof. The resulting two-phase product then flows through conduit 304 into high-stage propane chiller 2 wherein gaseous methane refrigerant introduced via conduit 152, natural gas feed introduced via conduit 100 and gaseous ethylene refrigerant introduced via conduit 202 are respectively cooled via indirect heat exchange means 4, 6 and 8 thereby producing cooled gas streams respectively produced via conduits 154, 102 and 204. The gas in conduit 154 is fed to main methane economizer 74 which will be discussed in greater detail in a subsequent section and wherein the stream is cooled via indirect heat exchange means 98. The resulting cooled compressed methane recycle stream produced via conduit 158 is then combined with the heavies depleted vapor stream in conduit 120 from the heavies removal column 60 and fed to the methane condenser 68.

The propane gas from chiller 2 is returned to compressor 18 through conduit 306. This gas is fed to the high stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to chiller 22 through conduit 310 thereby providing a coolant for chiller 22. The cooled feed gas stream from chiller 2 flows via conduit 102 to a knock-out vessel 10 wherein gas and liquid phases are separated. The liquid phase which is rich in $C_3$+ components is removed via conduit 103. The gaseous phase is removed via conduit 104 and then split into two separate streams which are conveyed via conduits 106 and 108. The stream in conduit 106 is fed to propane chiller 22. The stream in conduit 108 becomes the feed to heat exchanger 62 and is ultimately the stripping gas to the heavies removal column 60. Ethylene refrigerant from chiller 2 is introduced to chiller 22 via conduit 204. In chiller 22, the feed gas stream, also referred to herein as a methane-rich stream, and the ethylene refrigerant streams are respectively cooled via indirect heat transfer means 24 and 26 thereby producing cooled methane-rich and ethylene refrigerant streams via conduits 110 and 206. The thus evaporated portion of the propane refrigerant is separated and passed through conduit 311 to the intermediate-stage inlet of compressor 18. Liquid propane refrigerant from chiller 22 is removed via conduit 314, flashed acrossed a pressure reduction means, illustrated as expansion valve 16, and then fed to third stage chiller 28 via conduit 316.

As illustrated in FIG. 1, the methane-rich stream flows from the intermediate-stage propane chiller 22 to the low-stage propane chiller/condenser 28 via conduit 110. In this chiller, the stream is cooled via indirect heat exchange means 30. In a like manner, the ethylene refrigerant stream flows from the intermediate-stage propane chiller 22 to the low-stage propane chiller/condenser 28 via conduit 206. In the latter, the ethylene refrigerant is totally condensed or condensed in nearly its entirety via indirect heat exchange means 32. The vaporized propane is removed from the low-stage propane chiller/condenser 28 and returned to the low-stage inlet at the compressor 18 via conduit 320.

Although FIG. 1 illustrates cooling of streams provided by conduits 110 and 206 to occur in the same vessel, the chilling of stream 110 and the cooling and condensing of stream 206 may respectively take place in separate process vessels (ex., a separate chiller and a separate condenser, respectively). In a similar manner, the preceding cooling steps wherein multiple streams were cooled in a common vessel (ex., chiller) may be conducted in separate vessels. The former arrangement is a preferred embodiment because of the cost of multiple vessels and the requirement of less plant space.

As illustrated in FIG. 1, the methane-rich stream exiting the low-stage propane chiller is introduced to the high-stage ethylene chiller 42 via conduit 112. Ethylene refrigerant exits the low-stage propane chiller 28 via conduit 208 and is preferably fed to a separation vessel 37 wherein light components are removed via conduit 209 and condensed ethylene is removed via conduit 210. The separation vessel is analogous to the vessel earlier discussed for the removal of light components from liquefied propane refrigerant and may be a single-stage gas-liquid separator or may be a multiple stage operation which provides greater selectivity in the removal of light components from the system. The ethylene refrigerant at this location in the process is generally at a temperature of about −24° F. and a pressure of about 285 psia. The ethylene refrigerant via conduit 210 then flows to the ethylene economizer 34 wherein it is cooled via indirect heat exchange means 38 and removed via conduit 211 and passed to a pressure reduction means illustrated as an expansion valve 40 whereupon the refrigerant is flashed to a preselected temperature and pressure and fed to the high-stage ethylene chiller 42 via conduit 212. Vapor is removed from this chiller via conduit 214 and routed to the ethylene economizer 34 wherein the vapor functions as a coolant via indirect heat exchange means 46. The ethylene vapor is then removed from the ethylene economizer via conduit 216 and feed to the high-stage inlet on the ethylene compressor 48. The ethylene refrigerant which is not vaporized in the high-stage ethylene chiller 42 is removed via conduit 218 and returned to the ethylene economizer 34 for further cooling via indirect heat exchange means 50, removed from the ethylene economizer via conduit 220 and flashed in a pressure reduction means illustrated as expansion valve 52 whereupon the resulting two-phase product is introduced into the low-stage ethylene chiller 54 via conduit 222.

Removed from high-stage ethylene chiller 42 via conduit 116 is a methane-rich stream. This stream is then condensed in part via cooling provided by indirect heat exchange means 56 in low-stage ethylene chiller 54 thereby producing a two-phase stream which flows via conduit 118 to the benzene/aromatics/heavies removal column. As previously noted, the methane-rich stream in line 104 was split so as to flow via conduits 106 and 108. The contents of conduit 108 which is referred to herein as the methane-rich stripping gas is first fed to heat exchanger 62 wherein this stream is cooled via indirect heat exchange means 66 thereby becoming a cooled methane-rich stripping gas stream which then flows by conduit 109 to the benzene/heavies removal column 60. Liquid containing a significant concentration of benzene, other aromatics and/or heavier hydrocarbon components is removed from the benzene/heavies removal column 60 via conduit 114, preferably flashed via a flow control means which can also function as a pressure reduction means 97, preferably a control valve, and transported to heat exchanger 62 by conduit 117. Preferably, the stream flashed via flow control means 97 is flashed to a pressure about or greater than the pressure at the high stage inlet port to the methane compressor. Flashing also imparts greater cooling capacity to said stream. In the heat exchanger 62, the stream delivered by conduit 117 provides cooling capabilities via indirect heat exchange means 64 and exits said heat exchanger via conduit 119. In the benzene/aromatics/heavies removal column, the two-phase stream introduced via conduit 118 is contacted with the cooled methane-rich stripping gas stream introduced via conduit 109 in a countercurrent manner thereby producing a benzene/heavies-depleted, methane-rich vapor stream via conduit 120 and a benzene/heavies-enriched liquid stream via conduit 117.

The stream in conduit 119 is rich in benzene, other aromatics and/or other heavier hydrocarbon components. This stream is subsequently separated into liquid and vapor portions or preferably is flashed or fractionated in vessel 67. In each case a liquid stream rich in benzene, other aromatics and/or heavier hydrocarbon components and is produced via conduit 123 and a second methane-rich vapor stream is produced via conduit 121. In the preferred embodiment which is illustrated in FIG. 1, the stream in conduit 121 is subsequently combined with a second stream delivered via conduit 128 and the combined stream fed via conduit 140 to the high pressure inlet port on the methane compressor 83.

As previously noted, the gas in conduit 154 is fed to main methane economizer 74 wherein the stream is cooled via indirect heat exchange means 98. The resulting cooled compressed methane recycle or refrigerant stream in conduit 158 is combined in the preferred embodiment with the heavies depleted vapor stream from the heavies removal column 60 delivered via conduit 120 and fed to the low-stage ethylene condenser 68. In the low-stage ethylene condenser, this stream is cooled and condensed via indirect heat exchange means 70 with the liquid effluent from the low-stage ethylene chiller 54 which is routed to the low-stage ethylene condenser 68 via conduit 226. The condensed methane-rich product from the low-stage condenser is produced via conduit 122. The vapor from the low-stage ethylene chiller 54 withdrawn via conduit 224 and low-stage ethylene condenser 68 withdrawn via conduit 228 are combined and routed via conduit 230 to the ethylene economizer 34 wherein the vapors function as coolant via indirect heat exchange means 58. The stream is then routed via conduit 232 from the ethylene economizer 34 to the low-stage side of the ethylene compressor 48.

As noted in FIG. 1, the compressor effluent from vapor introduced via the low-stage side is removed via conduit 234, cooled via inter-stage cooler 71 and returned to compressor 48 via conduit 236 for injection with the high-stage stream present in conduit 216. Preferably, the two-stages are a single module although they may each be a separate module and the modules mechanically coupled to a common driver. The compressed ethylene product from the compressor is routed to a downstream cooler 72 via conduit 200. The product from the cooler flows via conduit 202 and is introduced, as previously discussed, to the high-stage propane chiller 2.

The liquefied stream in conduit 122 is generally at a temperature of about −125° F. and a pressure of about 600 psi. This stream passes via conduit 122 through the main methane economizer 74, wherein the stream is further cooled by indirect heat exchange means 76 as hereinafter explained. From the main methane economizer 74 the liquefied gas passes through conduit 124 and its pressure is reduced by a pressure reduction means which is illustrated as expansion valve 78, which of course evaporates or flashes a portion of the gas stream. The flashed stream is then passed to methane high-stage flash drum 80 where it is separated into a gas phase discharged through conduit 126 and a liquid phase discharged through conduit 130. The gas-phase is then transferred to the main methane economizer via conduit 126 wherein the vapor functions as a coolant via indirect heat transfer means 82. The vapor exits the main methane economizer via conduit 128 where it is combined with the gas stream delivered by conduit 121. These streams are then fed to the high pressure inlet port of compressor 83.

The liquid phase in conduit 130 is passed through a second methane economizer 87 wherein the liquid is further cooled by downstream flash vapors via indirect heat exchange means 88. The cooled liquid exits the second methane economizer 87 via conduit 132 and is expanded or flashed via pressure reduction means illustrated as expansion valve 91 to further reduce the pressure and at the same time, vaporize a second portion thereof. This flash stream is then passed to intermediate-stage methane flash drum 92 where the stream is separated into a gas phase passing through conduit 136 and a liquid phase passing through conduit 134. The gas phase flows through conduit 136 to the second methane economizer 87 wherein the vapor cools the liquid introduced to 87 via conduit 130 via indirect heat exchanger means 89. Conduit 138 serves as a flow conduit between indirect heat exchange means 89 in the second methane economizer 87 and the indirect heat transfer means 95 in the main methane economizer 74. This vapor leaves the main methane economizer 74 via conduit 140 which is connected to the intermediate stage inlet on the methane compressor 83.

The liquid phase exiting the intermediate stage flash drum 92 via conduit 134 is further reduced in pressure by passage through a pressure reduction means illustrated as a expansion valve 93. Again, a third portion of the liquefied gas is evaporated or flashed. The fluids from the expansion valve 93 are passed to final or low stage flash drum 94. In flash drum 94, a vapor phase is separated and passed through conduit 144 to the second methane economizer 87 wherein the vapor functions as a coolant via indirect heat exchange means 90, exits the second methane economizer via conduit 146 which is connected to the first methane economizer 74 wherein the vapor functions as a coolant via indirect heat exchange means 96 and ultimately leaves the first methane economizer via conduit 148 which is connected to the low pressure port on compressor 83.

The liquefied natural gas product from flash drum 94 which is at approximately atmospheric pressure is passed through conduit 142 to the storage unit. The low pressure, low temperature LNG boil-off vapor stream from the storage unit and optionally, the vapor returned from the cooling of the rundown lines associated with the LNG loading system, is preferably recovered by combining such stream or streams with the low pressure flash vapors present in either conduits 144, 146, or 148; the selected conduit being based on a desire to match vapor stream temperatures as closely as possible.

As shown in FIG. 1, the high, intermediate and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas in conduit 140 prior to the third-stage of compression. The compressed gas is discharged from the high-stage methane compressor through conduit 150, is cooled in cooler 86 and is routed to the high pressure propane chiller via conduit 152 as previously discussed.

FIG. 1 depicts the expansion of the liquefied phase using expansion valves with subsequent separation of gas and liquid portions in the chiller or condenser. While this simplified scheme is workable and utilized in some cases, it is often more efficient and effective to carry out partial evaporation and separation steps in separate equipment, for example, an expansion valve and separate flash drum might be employed prior to the flow of either the separated vapor or liquid to a propane chiller. In a like manner, certain process streams undergoing expansion are ideal candidates for employment of a hydraulic expander as part of the pressure reduction means thereby enabling the extraction of work energy and also lower two-phase temperatures.

With regard to the compressor/driver units employed in the process, FIG. 1 depicts individual compressor/driver units (i.e., a single compression train) for the propane, ethylene and open-cycle methane compression stages. However in a preferred embodiment for any cascaded process, process reliability can be improved significantly by employing a multiple compression train comprising two or more compressor/driver combinations in parallel in lieu of the depicted single compressor/driver units. In the event that a compressor/driver unit becomes unavailable, the process can still be operated at a reduced capacity.

Preferred Embodiment of the Inventive Removal Process and Apparatus

Presented in FIG. 2 is a preferred embodiment of the benzene, other aromatic and/or heavier hydrocarbon component removal process and associated apparatus. As previously noted, the two-phase stream fed to the benzene/aromatics/heavies removal column 60 via conduit 118 results from the cooling and partial condensing of the stream in conduit 116 via cooling provided by heat exchange means 56 in ethylene chiller 54. In one embodiment, the entire stream in conduit 116 is cooled. In a preferred embodiment illustrated in FIG. 2, the two-phase stream is obtained by cooling and partially condensing a portion of the stream in conduit 116 and this portion is then combined with the remaining portion of the stream originating via conduit 116.

Referring to FIG. 2, the stream delivered via conduit 116 is split into a first stream flowing in conduit 450 and a second stream flowing in conduit 452. The stream in conduit 532 flows through an optional valve 532, preferably a hand control valve, to conduit 454 which delivers the first stream to ethylene chiller 54 wherein the stream undergoes at least partial condensation via indirect heat exchange means 56 and exits said means via conduit 458. The second stream in conduit 452 flows through a valve 530, preferably a control valve, into conduit 456 which is then combined with the first stream delivered via conduit 458. The combined streams, now a two-phase stream, is delivered to column 60 via conduit 118. From an operational perspective, the length of conduit 118 should be sufficient to insure adequate mixing of the two streams such that equilibrium conditions are approached. The amount of liquids in the two-phase stream in conduit 118 is preferably controlled via maintaining the streams at a desired temperature. This is accomplished in the following manner. A temperature transducing device 688 in combination with a sensing device such as a thermocouple situated in conduit 118 provides an input signal 686 to a temperature controller 682. Also provided to the controller by operator or computer algorithm is a setpoint temperature signal 684. The controller 682 responds to the differences in the two inputs and transmits a signal 680 to the flow control valve 530 which is situated in a conduit wherein flows the portion of the stream delivered via conduit 116 which does not undergo cooling via heat exchanger means 56 in chiller 54. The transmitted signal 680 is scaled to be representative of the position of the control valve 530 required to maintain the flowrate necessary to obtain the desired temperature in conduit 118.

These feedstreams to the process step wherein benzene, other aromatic and/or heavy hydrocarbon components are removed are the two-phase process stream from ethylene chiller 54 delivered via conduit 118 to the upper section of column 60 and the methane-rich stripper gas delivered via conduit 108. Although depicted in FIG. 1 as originating from the feed gas stream from the first stage of propane cooling, this stream can originate from any location within the process or may be an outside methane-rich stream. As illustrated in FIG. 2, at least a portion of the methane-rich stripper gas undergoes cooling in heat exchanger 62 via indirect hem exchange means 62 prior to entering the base of column 60. Effluent streams from this inventive process step are the heavies-depleted gas stream from column 60 produced via conduit 120 and the warmed heavies-rich stream produced via conduit 119. As illustrated in FIG. 2, a heavy-rich stream is produced from column 60 and undergoes warming in heat exchanger 62 via indirect heat exchange means 66. It is in this manner that the column effluent produced via conduit 114 cools the stripping gas fed to the column via conduit 109.

The number of theoretical stages in column 60 will be dependent on the composition of the feedstreams to the column. Generally, two (2) to fifteen (15) theoretical stages will be required. The preferred number of stages is three (3) to ten (10), still more preferably is four (4) to eight (8) and from an operational and cost perspective, the most preferred number is about five (5). The theoretical stages may be made available via packing, plates/trays or a combination thereof. Generally, packing is preferred in columns of less than about six (6) ft. diameter and plates/trays on columns of greater than about six (6) ft. diameter. As illustrated in FIG. 2, the upper section of column wherein the two-phase stream in conduit 118 is fed is designed to facilitate gas/liquid separation. The top of the column preferably contains a means for demisting or removing entrained liquids from the vapor stream. This means is to be located between the point of entry of conduit 118 and the point of exit of conduit 120.

As illustrated in FIG. 2, the heavies-rich liquid stream produced via conduit 114 flows through control valve 97 and conduit 117 to heat exchanger 62 wherein said stream provides cooling via indirect heat transfer means 64 and is produced from heat exchanger 62 via conduit 119 as a warmed heavies-rich stream. Depending on the operational pressure of downstream processes, the cooling ability of this stream can be enhanced by flashing to a lower pressure upon flow through control valve 97. This process stream produced via conduit 119 may be utilized directly or undergo subsequent treatment for the removal of lighter components. In the preferred embodiment illustrated in FIG. 2, the stream is fed to a demethanizer 67.

The flowrate of heavies-rich liquid from column 60 may be controlled via various methodologies readily available to one skilled in the art. The control apparatus illustrated in FIG. 2 is a preferred apparatus and is comprised of a level controller device 600, also a sensing device, and a signal transducer connected to said level controller device, operably located in the lower section of column 60. The controller 600 establishes an output signal 602 that either typifies the flowrate in conduit 114 required to maintain a desired level in column 60 or indicates that the actual level has exceeded a predetermined level. A flow measurement device and transducer 604 operably located in conduit 114 establishes an output signal 606 that typifies the actual flowrate of the fluid in conduit 114. The flow measurement device is preferably located upstream of the control valve so as to avoid sensing a two-phase stream. Signal 602 is provided as a set point signal to flow controller 608. Signals 602 and 608 are respectively compared in flow controller 608 and controller 608 establishes an output signal 614 responsive to the difference between signals 602 and 606. Signal 614 is provided to control valve 97 and valve 97 is manipulated responsive to signal 614. A setpoint signal (not illustrated) representative of a desired level in column 60 may be manually inputted to level controller 600 by an operator or in the alternative, be under computer control via a control algorithm. Depending on the operating conditions, operator or computing machine logic is employed to determine whether control will be based on liquid level or flowrate. In response to the variable flowrate input of signal 606 and the selected setpoint signal, the controller 608 provides an output signal 614 which is responsive to the difference between the respective input and setpoint signals. This signal is scaled so as to be representative, as the case may be, of the position of the control valve 97 required to maintain the flowrate of fluid substantially equal to the desired flowrate or the liquid level substantially equal to the desired liquid level, as the case may be.

In the heat exchanger 62, the heavies-rich stream, which cools the methane-rich stripping gas stream, is routed to the heat exchanger via conduit 117. The heavies-rich stream flows thru indirect heat exchange means 66 and is produced from the heat exchanger via conduit 119. The degree to which the methane-rich stripping gas is cooled by the heavies-bearing stream prior to entry into the column may be controlled via various methodologies readily available to one skilled in the art. In one embodiment, the entire methane-rich stripping gas stream is fed to the heat exchanger and the degree of cooling controlled by such parameters as the amount of heavies-rich liquid stream made available for heat transfer, the heat transfer surface areas available for heat transfer and/or the residence times of the fluids undergoing heating or cooling as the case may be. In a preferred embodiment, the methane-rich stripping gas stream delivered via conduit 108 flows through control valve 500 into conduit 400 whereupon the stream is split and transferred via conduits 402 and 403. The stream flowing through conduit 403 ultimately flows through indirect heat transfer means 64 in heat exchanger 62. A means for manipulating the relative flowrates of fluid in conduits 402 and 403 is provided in either conduits 402 or 403 or both. The means illustrated in FIG. 2 are simple hand control valves, designated 502 and 504, which are respectively attached to conduits 404 and 407. However, a control valve whose position is manipulated by a controller and for which input to the controller is comprised of a setpoint and signal representative of flow in the conduit, such as that discussed above for the heavies-bearing stream, may be substituted for one or both of the hand control valves. In any event, the valves are operated such that the temperature approach difference of the streams in conduits 117 and 404 to heat exchanger 62 does not exceed 50° F. whereupon damage to the heat exchanger might result. The cooled fluid leaves the indirect heat transfer means 64 via conduit 405 and is combined at a junction point with uncooled methane-rich stripping gas delivered via conduit 407 thereby forming the cooled methane-rich stripping gas stream which is delivered to the column via conduit 109.

Operably located in conduit 109 is a flow transducing device 616 which in combination with a flow sensing device such as an orifice plate (not illustrated) establishes an output signal 618 that typifies the actual flowrate of the fluid in the conduit. Signal 618 is provided as a process variable input to a flow controller 620. Also provided either manually or via computer output is a set point value for the flowrate represented by signal 622. The flow controller then provides an output signal 624 which is responsive to the difference between the respective input and setpoint signals and which is scaled to be representative of the position of the control valve required to maintain the desired flowrate in conduit 109.

In another embodiment, the relative flowrate of fluid through conduits 402 and 403 can be controlled via locating a temperature sensing device and a transducer connected to said device, if so required, in conduit 109 and using the resulting output and a setpoint temperature as input to a flow controller which would generate an output signal responsive to the difference in the two signals and scaled to be representative of a control valve position required to maintain the desired flowrate in conduit 109. Such control valves could be substituted for hand valves 502 and/or 504.

The warmed heavies-rich liquid stream from heat exchanger 62 is fed via conduit 119 to the demethanizer column 67 which contains both rectifying and stripping sections. The rectifying and stripping sections may contain distinct stages (e.g., trays, plates) or may provide for continuous mass transfer via column packing (e.g., saddles, racking rings, woven wire) or a combination of the preceding. Generally, packing is preferred for columns possessing a diameter of less than about six (6) ft and distinct stages preferred for columns possessing a diameter of greater than about six (6) ft. The number of theoretical stages in both the rectifying and stripping sections is dependant on the desired composition of the final products and the composition of the feed stream. Preferably the stripping or lower section contains 4 to 20 theoretical stages, more preferably 8 to 12 theoretical stages, and most preferably about 10 theoretical stages. In a similar manner, the upper or rectifying section of the column preferably contains 4 to 20 theoretical stages, more preferably 8 to 13 theoretical stages, and most preferably about 10 theoretical stages.

A conventional reboiler 524 is provided at the bottom to provide stripping vapor. In the preferred embodiment presented in FIG. 2, liquid from the lower-most stage in the demethanizer is provided to the reboiler via conduit 428 wherein said fluid is heated via an indirect heat transfer means 525 with a heating medium delivered via conduit 440 and returned via conduit 442 which is connected to flow control valve 526 which is in turn connected to conduit 444. Vapor from the reboiler is returned to the demethanizer column via conduit 430 and liquids are removed from the reboiler via conduit 432. Said stream in conduit 432 may optionally be combined in conduit 436 with a second liquids stream produced from the bottom of the demethanizer via optional conduit 434. The total liquids stream produced from the demethanizer via conduits 436 and/or 432, as the case may be, may optionally flow thru cooler 520 and produced via conduit 438. A means for controlling liquid flow is inserted into one or both of the preceding conduits. In one embodiment as illustrated in FIG. 2, the flow control means is comprised of control valve 522 which is inserted between conduits 438 and 123. The position of the control valve 522 is manipulated by a flow controller 632 which is responsive to the differences between a setpoint input signal 628 from a level control device 626 and the actual flowrate of fluid in conduit 438 represented by signal 631. A set point flowrate 630 for level controller 626 may be provided via operator or computer algorithm input. Output from the controller 632 is signal 634 which is scaled to be representative of the position of the control valve 522 required to maintain the desired flowrate in conduit 438 to maintain the desired level in 67.

Although various control techniques are readily available for regulating the flowrate of stripping vapor to the column 67 via conduit 430, the preferred technique is based on the temperature of the return vapor. A temperature transducing device 636 in combination with a sensing device such as a thermocouple situated in conduit 430 provides an input signal 638 to a temperature controller 642. Also provided to the controller by operator or computer algorithm is a setpoint temperature signal 640. The controller 642 responds to the differences in the two inputs and transmits a signal 644 to the flow control valve 526 which is situated in a conduit containing the heating medium, preferably conduits 440 or 444, most preferably conduit 444 as illustrated. The transmitted signal 644 is scaled to be representative of the position of the control valve 526 required to maintain the flowrate necessary to obtain the desired temperature in conduit 440.

A novel aspect of the demethanizer column is the manner in which reflux liquids are generated. As illustrated in FIG. 2, the overhead product exits the demethanizer column 67 via conduit 410 whereupon at least a portion of said stream is partially condensed upon flowing through indirect heat exchange means 510 in heat exchanger 62 which is cooled via the heavies-rich liquid product from the heavies removal column 60. In a preferred embodiment, the heavies-rich liquid product is first employed for cooling of at least a portion of the overhead vapor stream and then employed for cooling of the methane-rich stripping gas stream. The condensed liquids resulting from cooling via the heavies-rich liquid stream become the source of the reflux for demethanizer column 67. Preferably, the heat exchange between the two designated streams occurs in a countercurrent manner. In one embodiment, the entire stream may flow to heat exchanger 62 in the manner previously discussed for the cooling of the entire methane stripping gas. In a preferred embodiment which is illustrated in FIG. 2, the overhead vapor product in conduit 410 is split into streams flowing in conduits 412 and 414. The stream in conduit 414 is cooled in heat exchanger 62 by flowing said stream through indirect heat exchange means 510 in exchanger 62 and the resulting cooled stream is produced via conduit 418. The relative flowrates of the vapor streams in conduits 412 and 414 or 418 are controlled by a flow control means, preferably a flow control valve through which overhead vapor may flow without flowing through the heat exchanger thereby avoiding the control of a two-phase fluid. Vapor flowing in conduit 412 flows through flow control means 512 and is produced therefrom via conduit 416. Conduits 416 and 418 are then joined thereby resulting in a combined cooled two-phase stream which flows through conduit 420. Situated in conduit 420 is a temperature transducing device 646, in combination with a temperature sensing device, preferably a thermocouple, provides a signal 648 representative of the actual temperature of the fluid flowing in conduit 420 to temperature controller 652. A desired temperature 650 is also inputted to the controller 652 either manually or via a computational algorithm. Based on a comparison of the input via the transducing device 646 and the setpoint 650, the controller 652 then provides an output signal 654 to the valve 512 which is scaled to manipulate the valve 512 in an appropriate manner such that the setpoint temperature is approached or maintained. The resulting two-phase fluid in conduit 420 is then fed to separator 514 from which is produced a methane-rich vapor stream via conduit 422 and a reflux liquid stream via conduit 424. In another preferred embodiment, the preceding methodology is employed but the heavies-rich stream in conduit 117 is first employed for cooling of the stream delivered via conduit 414 prior to cooling the stream delivered via conduit 414. As illustrated in FIG. 1, the methane rich vapor stream in conduit 121 can be returned to the open methane cycle for subsequent liquefaction. The pressure of the demethanizer and associated equipment is controlled by automatically manipulating control valve 518 responsive to a pressure transducer device 656 operably located in conduit 422. The control valve is connected on the inlet side to conduit 422 and on the outlet side to conduit 121 which preferably is directly or indirectly connected to the low pressure inlet port on the methane compressor, the pressure transducing device 656 in combination with a sensing device, provides a signal 658 to a pressure controller 660 which is representative of the actual pressure in conduit 422. A set point pressure signal 662 is also provided as input to the pressure controller 660. The controller then generates a response signal 664 representative of the difference between the pressure sensing device signal 658 and the setpoint signal 662. Signal 664 is scaled in such a manner as to activate the valve 518 according for approach and maintenance of the setpoint pressure. In one embodiment, the controller and control valve and optionally, the pressure sensing transducer 656 are embodied in a single device commonly called a back pressure regulator.

The reflux from the separator ultimately flows to the demethanizer. In the preferred embodiment illustrated in FIG. 2, the reflux leaves the separator 514 via conduit 424, flows thru pump 516, and then flows thru conduit 425, control valve 519, and conduit 426 whereupon the stream is introduced into the upper section of the demethanizer column. In this embodiment, the flowrate of reflux is controlled via input from a level control device 666 which is responsive to a sensing device located in the lower section of the separator 514. Controller 666 generates a signal 668 representative of the flowrate in conduit 426 required to maintain the desired level in separator 514, signal 668 is provided as a setpoint input to flow controller 670 to which is also fed a signal 671 which typifies the actual flowrate in conduit 425. The controller 670 then generates a signal 674 to control valve 519 which is representative of the difference in signals and scaled to provide for appropriate liquids flow through the flow control valve 519 such that liquid level in separator 514 is controlled.

The controllers previously discussed may use the various well-known modes of control such as proportional, proportional-integral, or proportional-integral-derivative (PID). In the preferred embodiments for temperature and flow control, a proportional-integral controller is utilized, but any controller capable of accepting two input signals and producing a scaled output signal, representative of a comparison of the two input signals, is within the scope of the invention. The operation of PID controllers is well known in the art. Essentially, the output signal of a controller may be scaled to represent any desired factor or variable. One example is where a desired temperature and an actual temperature are compared by a controller. The controller output could be a signal representative of a change in the flow rate of some fluid necessary to make the desired and actual temperatures equal. On the other hand, the same output signal could be scaled to represent a percentage, or could be scaled to represent a pressure change required to make the desired and actual temperatures equal.

While specific cryogenic methods, materials, items of equipment and control instruments are referred to herein, it is to be understood that such specific recitals are not to be considered limiting but are included by way of illustration and to set forth the best mode in accordance with the present invention.

EXAMPLE I

This Example shows via computer simulation the efficiency of the process described in the specification for the removal of benzene and heavier components from a methane-based stream immediately prior to liquefaction of the methane-based stream in major portion. The flowrates are representative to those existing in a 2.5 million metric tonne/year LNG plant employing the liquefaction technology set forth in FIGS. 1 and 2. The benzene concentrations in the methane-based gas streams employed in this Example are considered to be representative of those possessed by many candidate natural gas streams at this location in the process. However, the methane-based gas streams are considered to be relatively lean in the heavier hydrocarbon components (i.e., $C_3$+). Simulation results were obtained using Hyprotech's Process Simulation HYSIM, version 386/C2.10, Prop.Pkg PR/LK.

Presented in Table 1 are the compositions, temperatures, pressures and phase conditions of the influent and effluent streams to the heavies removal column. The simulation is based upon the column containing 5 theoretical stages. The partially condensed stream, also referred to as the two-phase stream, which will latter undergo liquefaction in major proportion is first fed to the uppermost stage in the column (Stage 1). The temperature of this stream is −112.5° F. and the pressure is 587.0 psia. As previous noted, this stream has undergone partial condensation such that the stream is 98.24 mol % vapor.

The cooled methane-rich stripping gas fed into the lowermost stage (Stage 5) is taken from the upstream location depicted in FIG. 1. This stream is cooled from approximately 63° F. to −10° F. via countercurrent heat exchange with the heavies-rich liquid stream produced from Stage 5. During such heat exchange as depicted in FIG. 2, this stream is heated from approximately −78° F. to approximately 62° F. This stream may also be employed to cool the overhead vapors from the demethanizer column. Presented in Table 2 are the simulated temperatures, pressures, and relative flowrates of each phase on a stagewise basis within the column. Presented in Table 3 for each stage are the respective liquid and vapor equilibrium compositions.

The warmed heavies-rich stream is then fed to the demethanizer column which contains rectifying and stripping sections wherefrom is produced a methane/ethane rich stream which preferably is recycled back as feed to the high stage inlet port on the methane compressor and a stream rich in natural gas liquids.

The efficiency of the process for aromatics/heavy removal is illustrated by a comparison of the combined nitrogen, methane and ethane mole percentages in the feed streams to Stages 1 and 5 and the product from Stage 1. These percentages for each stream are respectively 99.88, 99.89 and 99.94 mol percent. The process therefore produces a product stream richer in these light components than either of the two gaseous feed streams.

The efficiency of the process for benzene and heavier aromatics removal is illustrated by a comparison of the enrichment ratios which is defined to be the mole percent of said component in the liquid product from Stage 5 divided by the mole percent of said component in the vapor product from Stage 1. Using benzene as an example, the respective mole fractions are 0.1616E-04 and 0.00352. This results in an enrichment ratio of approximately 220.

An additional basis for illustrating the efficiency of the process are the enrichment ratios for the $C_3$+ components in the feed streams to Stages 1 and 5 and the liquid product stream produced from Stage 1. This ratio varies from about 45 for propane to about 200 for n-octane. The respective ratios between the product streams varies from about 50 for propane to about 20,000 for n-octane.

EXAMPLE II

This Example, like that previously presented, shows via computer simulation the efficiency of the process described in the specification for the removal of benzene and heavier components from a methane-based gas stream immediately prior to liquefaction of the stream in major portion. The flowrates are representative of those existing in a 2.5 million metric tonne/year LNG plant employing the liquefaction technology set forth in FIGS. 1 and 2. The benzene concentrations in the methane-rich feed streams employed in this Example are considered to be representative of the concentrations existing for many candidate gas streams at this location in the process. However, the concentrations of ethane and heavier components in the gas stream have been increased significantly thereby representing a richer gas stream and placing a greater burden on the process for the removal of both these components and benzene. This example illustrates in greater detail the ability of the process to simultaneously remove benzene and heavier hydrocarbon components. In addition, this Example illustrates the ability of the benzene removal process to tolerate significant process upsets in the form of significant increases in ethane and heavier hydrocarbon concentrations without significantly affecting the efficiency and operability of the benzene removal process. Furthermore, this example illustrates the ability of the process to recover heavies hydrocarbons as a separate liquefied stream. Simulation results were obtained using Hyprotech's Process Simulation HYSIM, version 386/C2.10, Prop. Pkg PR/LK.

Presented in Table 4 are the compositions, temperatures, pressures and phase conditions of the influent and effluent streams to the heavies removal column. The simulation is based upon the column containing 5 theoretical stages. The partially condensed stream, also referred to as the two-phase stream, which will undergo liquefaction in major proportion is first fed to the uppermost stage in the column (Stage 1). The temperature of this stream is −91.2° F. and the pressure is 596.0 psia. As noted in the Specification, this stream has undergone partial condensation such that the stream is 94.04 mol % vapor.

The methane-rich stripping stream fed into the lowermost stage (Stage 5) is taken from the upstream location depicted in FIG. 1. This stream is cooled from approximately −10 F. via countercurrent heat exchange with the liquid product stream produced from Stage 5. As noted in Table 4, this stream has undergone partial condensation in the course of cooling.

Presented in Table 5 are the simulated temperatures, pressures, and relative flowrates of each phase on a stage-wise basis within the column. Presented in Table 6 for each stage are the respective liquid and vapor equilibrium compositions.

The efficiency of the process for heavies removal is illustrated by a comparison of the combined nitrogen, methane and ethane mole percentages in the feed streams respectively to Stages 1 and 5 and the product stage from Stage 1. These percentages are respectively 97.85, 97.30, and 99.37 mol percent. The process produces a product stream significantly richer in these components than either of the two gaseous feed streams.

The efficiency of the process for benzene and heavier aromatics removal is illustrated by a comparison of the enrichment ratios which for benzene is as defined in Example 1. The respective mole fractions are 0.003E-04 and 0.00923 thus resulting in an enrichment ratio of approximately 30.

An additional basis for illustrating the efficiency of the process are the enrichment ratios for the $C_3$+ components in the feed streams to Stages 1 and 5 and the liquid product stream produced from Stage 1. This ratio varies from about 19 for propane to about 30 for n-octane. The respective ratios between the product streams varies from about 67 for propane to about 19,000 for n-octane.

TABLE 1

FEEDSTREAM AND SIMULATED PRODUCT STREAM COMPOSITIONS AND PROPERTIES

| | Feed Streams[1] | | Product Streams[1] | |
|---|---|---|---|---|
| | Stage 1 | Stage 5 | Stage 1 | Stage 5 |
| Nitrogen | 0.0022 | 0.0007 | 0.002169 | 0.000107 |
| $CO_2$ | 0.7587E−04 | 0.8806E−04 | 0.000075 | 0.000279 |
| Methane | 0.9726 | 0.9686 | 0.974167 | 0.559178 |
| Ethane | 0.0242 | 0.0296 | 0.023043 | 0.357346 |
| Ethylene | 0.0000 | 0.0000 | 0.000000 | 0.000000 |
| Propane | 0.0005 | 0.0006 | 0.000404 | 0.026993 |
| i-Butane | 0.8998E−04 | 0.0001 | 0.000055 | 0.009050 |
| n-Butane | 0.0001 | 0.0001 | 0.000059 | 0.013291 |
| i-Pentane | 0.3442E−04 | 0.4031E−04 | 0.000011 | 0.006026 |
| n-Pentane | 0.3340E−04 | 0.4031E−04 | 0.881E−05 | 0.006391 |
| n-Hexane | 0.2424E−04 | 0.3023E−04 | 0.257E−05 | 0.005627 |
| n-Heptane | 0.3230E−04 | 0.4031E−04 | 0.125E−05 | 0.008054 |
| n-Octane | 0.1615E−04 | 0.2015E−04 | 0.221E−06 | 0.004132 |
| Benzene | 0.1616E−04 | 0.2015E−04 | 0.258E−05 | 0.003526 |
| n-Nonane | 0.0000 | 0.0000 | 0.000000 | 0.000000 |
| Temperature | −112.45° F. | −10.00° F. | −112.32° F. | −78.09° F. |
| Pressure | 587.01 psia | 601.00 psia | 587.00 psia | 589.00 psia |
| Vapor % | 98.25% | 100% | 100% | 0.00% |
| Flowrate (lb mole/hr) | 60347.00 | 1203.0 | 61311.53 | 238.46 |

[1]Compositions are on mole fraction basis.

TABLE 2

SIMULATION RESULTS OF FLOW CHARACTERISTICS AND FLUID PROPERTIES WITHIN THE COLUMN

| | | | Flow Rates (lb mole/hr) | | | |
|---|---|---|---|---|---|---|
| Stage No. | Pressure psia | Temperature °F. | Liquid | Vapor | Feed | Product Streams |
| 1 | 587.0 | −112.3 | 1060.3 | | 60347.0[1] | 61311.5[2] |
| 2 | 587.5 | −108.2 | 917.8 | 2024.9 | | |
| 3 | 588.0 | −101.1 | 761.5 | 1882.4 | | |
| 4 | 588.5 | −90.8 | 619.0 | 1726.1 | | |
| 5 | 589.0 | −78.1 | | 1583.5 | 1203.0[3] | 238.5[4] |

[1]Feed to Stage 1 is 98.24 mol % vapor.
[2]Product removed from Stage 1, 100 mol % vapor.
[3]Feed to Stage 5, 100 mol % vapor.
[4]Product removed from Stage 5, 0 mol % vapor.

TABLE 3

SIMULATED LIQUID/VAPOR STREAM COMPOSITIONS LEAVING EACH THEORETICAL STAGE (Mole Fraction)

| | Nitrogen | $CO_2$ | Methane | Ethane | Propane | i-Butane | n-Butane |
|---|---|---|---|---|---|---|---|
| | | | | Stage 1 | | | |
| Vapor | 0.002169 | 0.00075 | 0.974167 | 0.023043 | 0.000404 | 0.000055 | 0.000055 |
| Liquid | 0.000772 | 0.000173 | 0.874962 | 0.105444 | 0.006229 | 0.002030 | 0.002965 |
| | | | | Stage 2 | | | |
| Vapor | 0.000811 | 0.000110 | 0.967766 | 0.030734 | 0.000436 | 0.000057 | 0.000059 |
| Liquid | 0.000263 | 0.000252 | 0.832784 | 0.145068 | 0.007288 | 0.002348 | 0.003425 |
| | | | | Stage 3 | | | |
| Vapor | 0.000565 | 0.000144 | 0.954226 | 0.044398 | 0.000514 | 0.000063 | 0.000064 |
| Liquid | 0.000159 | 0.000317 | 0.761049 | 0.211924 | 0.009202 | 0.002861 | 0.004152 |
| | | | | Stage 4 | | | |
| Vapor | 0.000547 | 0.000163 | 0.933571 | 0.064781 | 0.000745 | 0.000082 | 0.000080 |
| Liquid | 0.000131 | 0.000329 | 0.669188 | 0.295174 | 0.013204 | 0.003786 | 0.005372 |
| | | | | Stage 5 | | | |
| Vapor | 0.000571 | 0.000154 | 0.913194 | 0.084077 | 0.001548 | 0.000194 | 0.000191 |
| Liquid | 0.000107 | 0.000279 | 0.559178 | 0.357346 | 0.026933 | 0.009050 | 0.013291 |

| | i-Pentane | n-Pentane | n-Hexane | n-Heptane | n-Octane | Benzene |
|---|---|---|---|---|---|---|
| | | | Stage 1 | | | |
| Vapor | 0.000011 | 881E–06 | 2.57E–06 | 1.25E–06 | 2.21E–07 | 2.58E–06 |
| Liquid | 0.001331 | 0.001408 | 0.001236 | 0.001768 | 0.000907 | 0.000775 |
| | | | Stage 2 | | | |
| Vapor | 0.000011 | 8.54E–06 | 2.39E–06 | 1.12E–06 | 1.90E–07 | 2.35E–06 |
| Liquid | 0.001536 | 0.001625 | 0.001427 | 0.002042 | 0.001047 | 0.000894 |
| | | | Stage 3 | | | |
| Vapor | 0.000011 | 8.64E–06 | 2.30E–06 | 1.03E–06 | 1.68E–07 | 2.17E–06 |
| Liquid | 0.001854 | 0.001961 | 0.001720 | 0.002461 | 0.01262 | 0.001078 |
| | | | Stage 4 | | | |
| Vapor | 0.000014 | 0.000010 | 2.60E–06 | 1.14E–06 | 1.80E–07 | 2.31E–06 |
| Liquid | 0.002328 | 0.002446 | 0.002125 | 0.003031 | 0.001554 | 0.001332 |
| | | | Stage 5 | | | |
| Vapor | 0.000033 | 0.000024 | 6.08E–06 | 2.57E–06 | 3.93E–07 | 4.83E–06 |
| Liquid | 0.006026 | 0.006391 | 0.005627 | 0.008054 | 0.004132 | 0.003526 |

TABLE 4

FEEDSTREAM AND SIMULATED PRODUCT STREAM COMPOSITIONS AND PROPERTIES (Mole Fraction)

| | Feed Streams[1] | | Product Streams[1] | |
|---|---|---|---|---|
| | Stage 1 | Stage 5 | Stage 1 | Stage 5 |
| Nitrogen | 0.0024 | 0.0006 | 0.002301 | 0.000060 |
| $CO_2$ | 0.7074E–04 | 0.8851E–04 | 0.000072 | 0.000106 |
| Methane | 0.9478 | 0.9361 | 0.966005 | 0.346889 |
| Ethane | 0.0283 | 0.0363 | 0.025421 | 0.145714 |
| Ethylene | 0.0000 | 0.0000 | 0.000000 | 0.000000 |
| Propane | 0.0120 | 0.0145 | 0.005277 | 0.227598 |
| i-Butane | 0.0024 | 0.0030 | 0.000467 | 0.062744 |
| n-Butane | 0.0028 | 0.0036 | 0.000367 | 0.078635 |
| i-Pentane | 0.0010 | 0.0013 | 0.000049 | 0.030295 |
| n-Pentane | 0.0008 | 0.0011 | 0.000026 | 0.024383 |
| n-Hexane | 0.0013 | 0.0018 | 0.000012 | 0.043792 |
| n-Heptane | 0.0007 | 0.0010 | 0.170E–05 | 0.024376 |
| n-Octane | 0.0002 | 0.0003 | 0.111E–06 | 0.006019 |
| Benzene | 0.0003 | 0.0004 | 0.283E–05 | 0.009229 |
| n-Nonane | 0.4853E–05 | 0.6724E–05 | 0.851E–09 | 0.000160 |

TABLE 4-continued

FEEDSTREAM AND SIMULATED PRODUCT STREAM COMPOSITIONS AND PROPERTIES (Mole Fraction)

| | Feed Streams[1] | | Product Streams[1] | |
|---|---|---|---|---|
| | Stage 1 | Stage 5 | Stage 1 | Stage 5 |
| Temperature | –91.20° F. | –10.00° F. | –88.19° F. | –31.98° F. |
| Pressure | 596.01 psia | 610 psia | 596.00 psia | 598.00 psia |
| Vapor % | 94.04% | 98.94% | 100% | 0.00% |
| Flowrate (lb mole/hr) | 57109.78 | 7668.00 | 62724.19 | 2053.60 |

[1]Compositions are on mole fraction basis

TABLE 5

SIMULATION RESULTS OF FLOW CHARACTERISTICS AND FLUID PROPERTIES WITHIN THE COLUMN

| Stage No. | Pressure psia | Temperature °F. | Flow Rates (lb mole/hr) Liquid | Vapor | Feed | Product Streams |
|---|---|---|---|---|---|---|
| 1 | 596.0 | −88.2 | 3345.9 | | 57109.8[1] | 62724.2[2] |
| 2 | 596.5 | −67.6 | 2905.8 | 8960.3 | | |
| 3 | 597.0 | −52.5 | 2680.0 | 8520.2 | | |
| 4 | 597.5 | −42.3 | 2439.5 | 8294.4 | | |
| 5 | 598.0 | −32.0 | | 8053.9 | 7668.0[3] | 2053.6[4] |

[1]Feed to Stage 1 is 94.04 mole % vapor.

[2]Product removed from Stage 1, 100 mol % vapor.

[3]Feed to Stage 5, 98.94 mol % vapor.

[4]Product removed from Stage 5, 0 mol % vapor.

TABLE 6

SIMULATED LIQUID/VAPOR STREAM COMPOSITIONS LEAVING EACH THEORETICAL STAGE (Mole Fraction)

| | Nitrogen | $CO_2$ | Methane | Ethane | Propane | i-Butane | n-Butane |
|---|---|---|---|---|---|---|---|
| | | | | Stage 1 | | | |
| Vapor | 0.00231 | 0.000072 | 0.966005 | 0.025421 | 0.005277 | 0.000467 | 0.000367 |
| Liquid | 0.000359 | 0.000153 | 0.589261 | 0.132705 | 0.130329 | 0.033700 | 0.041711 |
| | | | | Stage 2 | | | |
| Vapor | 0.000640 | 0.000108 | 0.941610 | 0.047192 | 0.008898 | 0.000776 | 0.000615 |
| Liquid | 0.000085 | 0.000178 | 0.476845 | 0.190340 | 0.161161 | 0.039734 | 0.048783 |
| | | | | Stage 3 | | | |
| Vapor | 0.000561 | 0.000115 | 0.921470 | 0.062431 | 0.013142 | 0.001134 | 0.000905 |
| Liquid | 0.000069 | 0.000157 | 0.415375 | 0.208673 | 0.187549 | 0.044244 | 0.053820 |
| | | | | Stage 4 | | | |
| Vapor | 0.000569 | 0.000106 | 0.913713 | 0.064872 | 0.017638 | 0.001540 | 0.001229 |
| Liquid | 0.000065 | 0.000130 | 0.380377 | 0.191896 | 0.216335 | 0.050645 | 0.061013 |
| | | | | Stage 5 | | | |
| Vapor | 0.000583 | 0.000097 | 0.917993 | 0.055497 | 0.021253 | 0.002204 | 0.001837 |
| Liquid | 0.000060 | 0.000106 | 0.346889 | 0.145714 | 0.227598 | 0.062744 | 0.078635 |

| | i-Pentane | n-Pentane | n-Hexane | n-Heptane | n-Octane | Benzene | n-Nonane |
|---|---|---|---|---|---|---|---|
| | | | | Stage 1 | | | |
| Vapor | 0.000049 | 0.000026 | 0.000012 | 1.70E−06 | 1.11E−07 | 2.83E−06 | 8.51E−10 |
| Liquid | 0.015796 | 0.012679 | 0.022699 | 0.012625 | 0.003116 | 0.004784 | 0.000083 |
| | | | | Stage 2 | | | |
| Vapor | 0.000084 | 0.000046 | 0.000021 | 3.26E−06 | 2.23E−07 | 4.90E−06 | 1.78E−09 |
| Liquid | 0.018298 | 0.014662 | 0.026170 | 0.14543 | 0.003588 | 0.005516 | 0.000095 |
| | | | | Stage 3 | | | |
| Vapor | 0.000126 | 0.000069 | 0.000034 | 5.40E−06 | 3.87E−07 | 7.60E−06 | 3.21E−09 |
| Liquid | 0.019970 | 0.015971 | 0.028414 | 0.015775 | 0.003891 | 0.005988 | 0.000103 |
| | | | | Stage 4 | | | |
| Vapor | 0.000171 | 0.000095 | 0.000047 | 7.71E−06 | 5.67E−07 | 0.000010 | 4.82E−09 |
| Liquid | 0.022257 | 0.017730 | 0.031314 | 0.017348 | 0.004276 | 0.006598 | 0.000114 |

TABLE 6-continued

| SIMULATED LIQUID/VAPOR STREAM COMPOSITIONS LEAVING EACH THEORETICAL STAGE (Mole Fraction) | | | | | | | |
|---|---|---|---|---|---|---|---|
| | | | | Stage 5 | | | |
| Vapor | 0.000273 | 0.000154 | 0.000079 | 0.000013 | 9.77E-07 | 0.00017 | 8.41E-09 |
| Liquid | 0.030295 | 0.024383 | 0.043792 | 0.024376 | 0.006019 | 0.009229 | 0.000160 |

That which is claimed:

1. A process for removing and concentrating the higher molecular weight hydrocarbon species from a methane-based gas stream comprising the steps of:

(a) condensing a minor portion of the methane-based gas stream thereby producing a two-phase stream;

(b) feeding said two-phase stream into the upper section of a column;

(c) removing from the upper section of said column a heavies-depleted gas stream;

(d) removing from the lower section of said column a heavies-rich liquid stream;

(e) contacting via indirect heat exchange the heavies-rich liquid stream with a methane-rich stripping gas stream thereby producing a warmed heavies-rich stream and a cooled methane-rich stripping gas stream;

(f) feeding said cooled methane-rich stripping gas stream to the lower section of the column; and (g) contacting the two-phase stream and the cooled methane-rich stripping gas stream in said column thereby producing the heavies-depleted gas stream and the heavies-rich liquid stream.

2. A process according to claim 1 wherein step (a) is comprised of splitting the methane-based gas stream into a first stream and a second stream, cooling said first stream thereby producing a partially condensed first stream, and combining said first stream thereby producing a partially condensed first stream, and combining said partially condensed first stream with the second stream thereby producing said two-phase stream.

3. A process according to claim 2 wherein the amount of liquids in said two-phase stream is controlled by determining for the methane-based gas stream a two-phase stream temperature corresponding to the desired liquids content at equilibrium conditions, measuring the temperature of the two-phase stream, maintaining constant the flowrate of the first stream and the amount of cooling imparted to said stream, and adjusting the flowrate of said second stream responsive to the two-phase stream temperature such that the two-phase stream temperature approximates the calculated two-phase stream temperature.

4. A process according to claim 1 additionally comprising the step of (h) sequentially cooling the methane-based gas stream prior to step (a) by flowing said stream through at least one indirect heat exchange means in contact with a first refrigerant stream thereby producing a cooled methane-based gas stream and flowing the cooled methane-based gas stream through at least one indirect heat exchange means in contact with a second refrigerant stream wherein the boiling point of the second refrigerant stream is less than the boiling point of the first refrigerating stream thereby producing the feedstream to step (a).

5. A process according to claim 4 wherein said first refrigerant stream is comprised in major portion of propane and said second refrigerant stream is comprised in major portion of ethane, ethylene or a mixture thereof.

6. A process according to claim 4 further comprising:

(i) withdrawing a side stream from the methane-based gas stream at a location downstream of one of the indirect heat exchange means and employing said side stream as the methane-rich stripping gas in step (e).

7. A process according to claim 4 wherein said cooling by at least one indirect heat exchange means in contact with a first refrigerant stream is comprised of flowing said gas stream to be cooled through two or more indirect heat exchange means in a sequential manner and wherein the first refrigerant to each such indirect heat exchange means has been flashed to a progressively lower temperature and pressure in a sequentially consistent manner and wherein said cooling by at least one indirect heat exchange means in contact with a second refrigerant stream is comprised of flowing said gas stream to be cooled through two or more indirect heat exchange means in a sequential manner and wherein the second refrigerant to each indirect heat exchange means has been flashed to a progressively lower temperature and pressure in a sequentially consistent manner.

8. A process according to claim 7 wherein three indirect heat exchange means are employed for cooling by the first refrigerant stream and two or three indirect heat exchange means are employed for cooling by the second refrigerant stream.

9. A process according to claim 7 wherein the pressure of the methane-based feed gas is 500 to 900 psia.

10. A process according to claim 7 wherein the pressure of the methane-based feed gas is about 575 to about 650 psia.

11. A process according to claim 10 further comprising:

(i) withdrawing a side stream from the methane-based gas stream at a location downstream of one of the indirect heat exchange means and employing said side stream as the methane-rich stripping gas in step (e).

12. A process according to claim 1 additionally comprising:

(h) feeding the warmed heavies-rich stream of step (e) to a demethanizer comprised of a fractionator, a reboiler and a condenser thereby producing a heavies-rich liquid stream and a methane-rich vapor stream.

13. A process according to claim 12 wherein a major portion of the cooling duty for the condenser is provided by the heavies-rich liquid stream produced by step (d) or step (e).

14. A process according to claim 12 wherein a major portion of the cooling duty for the condenser is provided by flowing through an indirect heat exchange means in contact with the heavies-rich liquid stream of step (d) and the resulting treated heavies-rich liquid stream becomes the heavies-bearing feedstream to step (e).

15. A process according to claim 13 wherein the cooling duty is provided by splitting the overhead vapor stream into a first vapor stream and a second vapor stream, cooling and partially condensing said first stream via indirect heat exchange with the heavies rich liquid stream of step (d) thereby producing a cooled, partially condensed first stream, combining said first stream and said second stream, feeding said combined stream to a gas-liquid separator from which is produced the reflux stream to the fractionating column and the methane-rich vapor stream.

16. A process according to claim 15 wherein the flowrate of the reflux stream is controlled by calculating for the overhead vapor stream a two-phase stream temperature corresponding to the desired liquids content at equilibrium conditions, measuring the temperature of the two-phase stream, maintaining constant the flowrate of the first stream and the amount of cooling imparted to said stream, and adjusting the flowrate of said second stream responsive to the two-phase stream temperature such that the calculated two-phase stream temperature is approached.

17. A process according to claim 13 additionally comprising between steps (d) and (e) the additional step of:

(i) flashing the heavies-rich liquid stream to a lower pressure thereby further decreasing the temperature of said stream.

18. A process according to claim 17 additionally comprising the step of (j) condensing the heavies depleted gas stream thereby producing a liquefied natural gas stream.

19. A process according to claim 18 wherein said condensing is comprised of flowing the heavies depleted gas stream through an indirect heat exchange means cooled by said second refrigerant stream.

20. A process according to claim 19 wherein the pressure of the methane-based gas stream is 500 to 900 psia.

21. A process according to claim 20 additionally comprising the steps of (k) flashing in one or more steps the liquefied product of step (j) to approximately atmospheric pressure thereby producing an LNG product stream and one or more methane vapor streams;

(l) compressing a majority of the vapor streams of step (k) to a pressure of 500 to 900 psia, (m) cooling said compressed vapor stream of step (l); and (n) combining the resulting cooled stream with the methane-based gas stream fed to step (a) or the resulting product from one of the indirect heat exchange means of step (h).

22. A process according to claim 21 wherein the methane-rich vapor stream of step (h) is combined with one of the vapor streams of step (k) prior to step (l).

23. A process according to claim 21 wherein the pressure of the methane-based feed gas and the gas stream from step (l) is about 575 to about 650 psia.

24. A process according to claim 1 wherein the column provides two to fifteen theoretical stages of gas-liquid contacting.

25. A process according to claim 1 wherein the column provides three to ten theoretical stages of gas-liquid contacting.

26. A process according to claim 23 wherein the column provides two to fifteen theoretical stages of gas-liquid contacting.

27. A process according to claim 23 wherein the column provides three to ten theoretical stages of gas-liquid contacting.

28. A process for removing benzene and other aromatics from a methane-based gas stream comprising the steps of:

(a) condensing a minor portion of the methane-based gas stream thereby producing a two-phase stream;

(b) feeding said two-phase stream into the upper section of a column (c) removing from the upper section of said column a benzene/aromatic-depleted gas stream;

(d) removing from the lower section of said column a benzene/aromatic-rich liquid stream;

(e) contacting via indirect heat exchange the benzene/aromatic-rich liquid stream with a methane-rich stripping gas stream thereby producing a warmed benzene/aromatic-rich stream and a cooled methane-rich stripping gas stream;

(f) feeding said cooled methane-rich stripping gas stream to the lower section of the column; and (g) contacting the two-phase stream and the cooled methane-rich stripping gas stream in said column thereby producing the benzene/aromatic-depleted gas stream and the benzene/aromatic-rich liquid stream.

29. A process according to claim 28 wherein step (a) is comprised of splitting the methane-based gas stream into a first stream and a second stream, cooling said first stream thereby producing a partially condensed first stream, and combining said partially condensed first stream with the second stream thereby producing said two-phase stream.

30. A process according to claim 29 wherein the amount of liquids in said two-phase stream is controlled by determining for the methane-based gas stream a two-phase stream temperature corresponding to the desired liquids content at equilibrium conditions, measuring the temperature of the two-phase stream, maintaining constant the flowrate of the first stream and the amount of cooling imparted to said stream, and adjusting the flowrate of said second stream responsive to the two-phase stream temperature such that the two-phase stream temperature approximates the calculated two-phase stream temperature.

31. A process according to claim 28 additionally comprising the step of (h) sequentially cooling the methane-based gas stream prior to step (a) by flowing said stream through at least one indirect heat exchange means in contact with a first refrigerant stream thereby producing a cooled methane-based gas stream and flowing the cooled methane-based gas stream through at least one indirect heat exchange means in contact with a second refrigerant stream where the boiling point of the second refrigerant stream is less than the boiling point of the first refrigerating stream thereby producing the feedstream to step (a).

32. A process according to claim 31 wherein said first refrigerant stream is comprised in major portion of propane and said second refrigerant stream is comprised in major portion of ethane, ethylene or a mixture thereof.

33. A process according to claim 31 further comprising:

(i) withdrawing a side stream from the methane-based gas stream at a location downstream of one of the indirect heat exchange means and employing said side stream as the methane-rich stripping gas in step (e).

34. A process according to claim 31 wherein said cooling by at least one indirect heat exchange means in contact with a first refrigerant stream is comprised of flowing said gas stream to be cooled through two or more indirect heat exchange means in a sequential manner and wherein the first refrigerant to each such indirect heat exchange means has been flashed to a progressively lower temperature and pressure in a sequentially consistent manner and wherein said cooling by at least one indirect heat exchange means in contact with a second refrigerant stream is comprised of flowing said gas stream to be cooled through two or more indirect heat exchange means in a sequential manner and wherein the second refrigerant to each indirect heat exchange means has been flashed to a progressively lower temperature and pressure in a sequentially consistent manner.

35. A process according to claim 34 wherein three indirect he exchange means are employed for cooling by the first refrigerant stream and two or three indirect heat exchange means are employed for cooling by the second refrigerant stream.

36. A process according to claim 34 wherein the pressure of the methane-based feed gas is 500 to 900 psia.

37. A process according to claim 34 wherein the pressure of the methane-based feed gas is about 575 to about 650 psia.

38. A process according to claim 37 further comprising:

(i) withdrawing a side stream from the methane-based gas stream at a location downstream of one of the indirect heat exchange means and employing said side stream as the methane-rich stripping gas in step (e).

39. A process according to claim 28 additionally comprising:

(h) feeding the warmed benzene/aromatic-rich stream of step (e) to a demethanizer comprised of a fractionator column, a reboiler and a condenser thereby producing a benzene/aromatic-rich liquid stream and a methane-rich vapor stream.

40. A process according to claim 39 wherein a major portion of the cooling duty for the condenser is provided by the benzene/aromatic-rich liquid stream produced by step (d) or step (e).

41. A process according to claim 39 wherein a major portion of the cooling duty for the condenser is provided by flowing through an indirect heat exchange means in contact with the benzene/aromatic-rich liquid stream of step (d) and the resulting treated benzene/aromatic-rich liquid stream becomes the benzene/aromatic-bearing feedstream to step (e).

42. A process according to claim 40 wherein the cooling duty is provided by splitting the overhead vapor stream into a first vapor stream and a second vapor stream, cooling and partially condensing said first stream via indirect heat exchange with the benzene/aromatic rich liquid stream of step (d) thereby producing a cooled, partially condensed first stream, combining said first stream and said second stream, feeding said combined stream to a gas-liquid separator from which is produced the reflux stream to the fractionating column and the methane-rich vapor stream.

43. A process according to claim 42 wherein the flowrate of the reflux stream is controlled by calculating for the overhead vapor stream a two-phase stream temperature corresponding to the desired liquids content at equilibrium conditions, measuring the temperature of the two-phase stream, maintaining constant the flowrate of the first stream and the amount of cooling imparted to said stream, and adjusting the flowrate of said second stream responsive to the two-phase stream temperature such that the calculated two-phase stream temperature is approached.

44. A process according to claim 40 additionally comprising between steps (d) and (e) the additional step of:

(i) flashing the benzene/aromatic-rich liquid stream to a lower pressure thereby further decreasing the temperature of said stream.

45. A process according to claim 44 additionally comprising the step of (j) condensing the benzene/aromatic depleted gas stream thereby producing a liquefied natural gas stream.

46. A process according to claim 45 wherein said condensing is comprised of flowing the benzene/aromatic depleted gas stream through an indirect heat exchange means cooled by said second refrigerant stream.

47. A process according to claim 46 wherein the pressure of the methane-based gas stream is 500 to 900 psia.

48. A process according to claim 47 additionally comprising the steps of (k) flashing in one or more steps the liquefied product of step (j) to approximately atmospheric pressure thereby producing an LNG product stream and one or more methane vapor streams;

(l) compressing a majority of the vapor streams of step (k) to a pressure of 500 to 900 psia, (m) cooling said compressed vapor stream of step (l); and (n) combining the resulting cooled stream with the methane-based gas stream fed to step (a) or the resulting product from one of the indirect heat exchange means of step (h).

49. A process according to claim 48 wherein the methane-rich vapor stream of step (h) is combined with one of the vapor streams of step (k) prior to step (o).

50. A process according to claim 48 wherein the pressure of the methane-based feed gas and the gas stream from step (l) is about 575 to about 650 psia.

51. A process according to claim 28 wherein the column provides two to fifteen theoretical stages of gas-liquid contacting.

52. A process according to claim 28 wherein the column provides three to ten theoretical stages of gas-liquid contacting.

53. A process according to claim 50 wherein the column provides two to fifteen theoretical stages of gas-liquid contacting.

54. A process according to claim 50 wherein the column provides three to ten theoretical stages of gas-liquid contacting.

* * * * *